US010388205B2

(12) United States Patent
Cok et al.

(10) Patent No.: US 10,388,205 B2
(45) **Date of Patent: *Aug. 20, 2019**

(54) BIT-PLANE PULSE WIDTH MODULATED DIGITAL DISPLAY SYSTEM

(71) Applicant: X-Celeprint Limited, Cork (IE)

(72) Inventors: Ronald S. Cok, Rochester, NY (US); Robert R. Rotzoll, Colorado Springs, CO (US); Christopher Andrew Bower, Raleigh, NC (US)

(73) Assignee: X-Celeprint Limited, Cork (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/054,839

(22) Filed: Aug. 3, 2018

(65) Prior Publication Data

US 2018/0342191 A1 Nov. 29, 2018

Related U.S. Application Data

(63) Continuation of application No. 15/476,684, filed on Mar. 31, 2017, now Pat. No. 10,157,563, which is a (Continued)

(51) Int. Cl.
*G09G 3/20* (2006.01)
*G09G 3/32* (2016.01)

(Continued)

(52) U.S. Cl.
CPC ..... *G09G 3/2003* (2013.01); *F21K 9/90* (2013.01); *G09G 3/2022* (2013.01); *G09G 3/32* (2013.01);

(Continued)

(58) Field of Classification Search
CPC ..... G09G 3/2003; G09G 3/32; G09G 3/3208; G09G 3/2022; F21K 9/90; H05B 33/0842
See application file for complete search history.

(56) References Cited

U.S. PATENT DOCUMENTS 5,550,066 A 8/1996 Tang et al.
5,621,555 A 4/1997 Park (Continued)

FOREIGN PATENT DOCUMENTS

GB 2 496 183 A 5/2013
WO WO-2006/027730 A1 3/2006

(Continued)

OTHER PUBLICATIONS

Bower, C. A. et al., Transfer Printing: An Approach for Massively Parallel Assembly of Microscale Devices, IEE, Electronic Components and Technology Conference, (2008).

(Continued)

*Primary Examiner* — Sardis F Azongha
(74) *Attorney, Agent, or Firm* — Michael D. Schmitt; William R. Haulbrook; Choate, Hall & Stewart LLP

(57) ABSTRACT

A digital-drive display system, comprising an array of display pixels, each display pixel having a light emitter, a digital memory for storing a digital pixel value, and a drive circuit that drives the light emitter in response to the digital pixel value. The drive circuit can respond to a control signal provided to all of the display pixels in common by a display controller that loads digital pixel values in the digit memory of each display pixel.

22 Claims, 11 Drawing Sheets

Related U.S. Application Data continuation of application No. 14/835,282, filed on Aug. 25, 2015, now Pat. No. 9,640,108.

(51) Int. Cl.
*G09G 3/3208* (2016.01)
*F21K 9/90* (2016.01)
*H05B 33/08* (2006.01)

(52) U.S. Cl.
CPC ..... *G09G 3/3208* (2013.01); *H05B 33/0842* (2013.01); *G09G 2300/0408* (2013.01); *G09G 2300/0452* (2013.01); *G09G 2300/0465* (2013.01); *G09G 2300/0819* (2013.01); *G09G 2300/0857* (2013.01); *G09G 2310/027* (2013.01); *G09G 2310/0286* (2013.01); *G09G 2310/0294* (2013.01); *G09G 2310/08* (2013.01); *G09G 2320/0247* (2013.01); *G09G 2320/0666* (2013.01); *G09G 2330/028* (2013.01); *G09G 2360/12* (2013.01)

(56) References Cited

U.S. PATENT DOCUMENTS 5,731,802 A 3/1998 Aras et al.
5,815,303 A 9/1998 Berlin
5,912,712 A 6/1999 Doherty
5,994,722 A 11/1999 Averbeck et al.
6,084,579 A 7/2000 Hirano
6,142,358 A 11/2000 Cohn et al.
6,184,477 B1 2/2001 Tanahashi
6,278,242 B1 8/2001 Cok et al.
6,392,340 B2 5/2002 Yoneda et al.
6,448,718 B1 9/2002 Battersby
6,466,281 B1 10/2002 Huang et al.
6,577,367 B2 6/2003 Kim
6,660,457 B1 12/2003 Imai et al.
6,717,560 B2 4/2004 Cok et al.
6,756,576 B1 6/2004 McElroy et al.
6,812,637 B2 11/2004 Cok et al.
6,933,532 B2 8/2005 Arnold et al.
7,012,382 B2 3/2006 Cheang et al.
7,091,523 B2 8/2006 Cok et al.
7,129,457 B2 10/2006 McElroy et al.
7,195,733 B2 3/2007 Rogers et al.
7,288,753 B2 10/2007 Cok
7,402,951 B2 7/2008 Cok
7,420,221 B2 9/2008 Nagai
7,443,438 B2 10/2008 Kakumoto et al.
7,466,075 B2 12/2008 Cok et al.
7,521,292 B2 4/2009 Rogers et al.
7,557,367 B2 7/2009 Rogers et al.
7,586,497 B2 9/2009 Boroson et al.
7,622,367 B1 11/2009 Nuzzo et al.
7,662,545 B2 2/2010 Nuzzo et al.
7,687,812 B2 3/2010 Louwsma et al.
7,704,684 B2 4/2010 Rogers et al.
7,738,001 B2 6/2010 Routley et al.
7,791,271 B2 9/2010 Cok et al.
7,799,699 B2 9/2010 Nuzzo et al.
7,816,856 B2 10/2010 Cok et al.
7,834,541 B2 11/2010 Cok
7,893,612 B2 2/2011 Cok
7,919,342 B2 4/2011 Cok
7,927,976 B2 4/2011 Menard
7,932,123 B2 4/2011 Rogers et al.
7,943,491 B2 5/2011 Nuzzo et al.
7,969,085 B2 6/2011 Cok
7,972,875 B2 7/2011 Rogers et al.
7,982,296 B2 7/2011 Nuzzo et al.
7,990,058 B2 8/2011 Cok et al.
7,999,454 B2 8/2011 Winters et al.
8,029,139 B2 10/2011 Ellinger et al.
8,039,847 B2 10/2011 Nuzzo et al.
8,115,380 B2 2/2012 Cok et al.
8,198,621 B2 6/2012 Rogers et al.
8,207,547 B2 6/2012 Lin
8,207,635 B2 6/2012 Covaro
8,243,027 B2 8/2012 Hotelling et al.
8,261,660 B2 9/2012 Menard
8,334,545 B2 12/2012 Levermore et al.
8,394,706 B2 3/2013 Nuzzo et al.
8,421,791 B2 4/2013 Harada
8,440,546 B2 5/2013 Nuzzo et al.
8,450,927 B2 5/2013 Lenk et al.
8,470,701 B2 6/2013 Rogers et al.
8,502,192 B2 8/2013 Kwak et al.
8,506,867 B2 8/2013 Menard
8,558,243 B2 10/2013 Bibl et al.
8,664,699 B2 3/2014 Nuzzo et al.
8,686,447 B2 4/2014 Tomoda et al.
8,722,458 B2 5/2014 Rogers et al.
8,754,396 B2 6/2014 Rogers et al.
8,766,970 B2 7/2014 Chien et al.
8,791,474 B1 7/2014 Bibl et al.
8,794,501 B2 8/2014 Bibl et al.
8,803,857 B2 8/2014 Cok
8,817,369 B2 8/2014 Daiku
8,835,940 B2 9/2014 Hu et al.
8,854,294 B2 10/2014 Sakariya
8,877,648 B2 11/2014 Bower et al.
8,889,485 B2 11/2014 Bower
8,895,406 B2 11/2014 Rogers et al.
8,941,215 B2 1/2015 Hu et al.
8,987,765 B2 3/2015 Bibl et al.
9,049,797 B2 6/2015 Menard et al.
9,105,714 B2 8/2015 Hu et al.
9,139,425 B2 9/2015 Vestyck
9,153,171 B2 * 10/2015 Sakariya ..... G09G 3/3233
9,161,448 B2 10/2015 Menard et al.
9,165,989 B2 10/2015 Bower et al.
9,166,114 B2 10/2015 Hu et al.
9,178,123 B2 11/2015 Sakariya et al.
9,202,996 B2 12/2015 Orsley et al.
9,217,541 B2 12/2015 Bathurst et al.
9,355,854 B2 5/2016 Meitl et al.
9,358,775 B2 6/2016 Bower et al.
9,478,583 B2 10/2016 Hu et al.
9,484,504 B2 11/2016 Bibl et al.
9,520,537 B2 12/2016 Bower et al.
9,555,644 B2 1/2017 Rogers et al.
9,570,532 B2 2/2017 Huangfu et al.
9,601,356 B2 3/2017 Bower et al.
9,626,908 B2 * 4/2017 Sakariya ..... G09G 3/3233
9,640,108 B2 5/2017 Cok et al.
9,640,715 B2 5/2017 Bower et al.
9,660,008 B2 5/2017 Bower et al.
9,761,754 B2 9/2017 Bower et al.
9,765,934 B2 9/2017 Rogers et al.
9,786,646 B2 10/2017 Cok et al.
9,818,725 B2 11/2017 Bower et al.
9,865,832 B2 1/2018 Bibl et al.
9,923,133 B2 3/2018 Bower et al.
9,928,771 B2 3/2018 Cok
9,929,053 B2 3/2018 Bower et al.
9,930,277 B2 3/2018 Cok
9,959,815 B2 * 5/2018 Sakariya ..... G09G 3/3233
10,157,153 B2 12/2018 Shacham et al.
2001/0022564 A1 9/2001 Youngquist et al.
2002/0078559 A1 6/2002 Buchwalter et al.
2002/0096994 A1 7/2002 Iwafuchi et al.
2002/0154101 A1 10/2002 Abe et al.
2003/0062545 A1 4/2003 Yamazaki et al.
2003/0117369 A1 6/2003 Spitzer et al.
2003/0141570 A1 7/2003 Chen et al.
2003/0189829 A1 10/2003 Shimizu et al.
2003/0201986 A1 10/2003 Willis et al.
2003/0223275 A1 12/2003 Abe
2004/0140763 A1 7/2004 Buchwalter et al.
2004/0212296 A1 10/2004 Nakamura et al.
2004/0227704 A1 11/2004 Wang et al.
2004/0252933 A1 12/2004 Sylvester et al.
2005/0012076 A1 1/2005 Morioka

(56) References Cited

U.S. PATENT DOCUMENTS

2005/0040754 A1 2/2005 Sakurai
2005/0104833 A1 5/2005 Ochi et al.
2005/0116621 A1 6/2005 Bellmann et al.
2005/0140275 A1 6/2005 Park
2005/0168987 A1 8/2005 Tamaoki et al.
2005/0253159 A1 11/2005 Creswick et al.
2005/0275615 A1 12/2005 Kahen et al.
2006/0063309 A1 3/2006 Sugiyama et al.
2006/0170623 A1 8/2006 Naugler et al.
2007/0035340 A1 2/2007 Kimura
2007/0077349 A1 4/2007 Newman et al.
2007/0132674 A1 6/2007 Tsuge
2007/0201056 A1 8/2007 Cok et al.
2007/0216610 A1 9/2007 Smith
2007/0252856 A1 11/2007 Hudson et al.
2008/0174515 A1 7/2008 Matthies et al.
2008/0180381 A1 7/2008 Jeong et al.
2008/0259019 A1 10/2008 Ng
2009/0096742 A1 4/2009 Huang
2009/0147033 A1 6/2009 Arai et al.
2009/0273303 A1 11/2009 Peng
2009/0289559 A1 11/2009 Tanaka et al.
2009/0315054 A1 12/2009 Kim et al.
2010/0045690 A1 2/2010 Handschy et al.
2010/0078670 A1 4/2010 Kim et al.
2010/0085295 A1 4/2010 Zhao et al.
2010/0123268 A1 5/2010 Menard
2010/0156766 A1 6/2010 Levey et al.
2010/0207848 A1 8/2010 Cok
2010/0207852 A1 8/2010 Cok
2010/0214247 A1 8/2010 Tang et al.
2010/0248484 A1 9/2010 Bower et al.
2010/0258710 A1 10/2010 Wiese et al.
2010/0306993 A1 12/2010 Mayyas et al.
2010/0317132 A1 12/2010 Rogers et al.
2011/0057861 A1 3/2011 Cok et al.
2011/0084993 A1 4/2011 Kawabe
2011/0199011 A1 8/2011 Nakazawa
2011/0211348 A1 9/2011 Kim
2012/0126229 A1 5/2012 Bower
2012/0206421 A1 8/2012 Cok et al.
2012/0206499 A1 8/2012 Cok
2012/0228669 A1 9/2012 Bower et al.
2012/0307123 A1 12/2012 Cok et al.
2012/0314388 A1 12/2012 Bower et al.
2013/0015483 A1 1/2013 Shimokawa et al.
2013/0069275 A1 3/2013 Menard et al.
2013/0088416 A1 4/2013 Smith et al.
2013/0141469 A1 6/2013 Xu
2013/0153277 A1 6/2013 Menard et al.
2013/0196474 A1 8/2013 Meitl et al.
2013/0207964 A1 8/2013 Fleck et al.
2013/0221355 A1 8/2013 Bower et al.
2013/0273695 A1 10/2013 Menard et al.
2013/0316487 A1 11/2013 de Graff et al.
2014/0055654 A1 2/2014 Borthakur et al.
2014/0104243 A1 4/2014 Sakariya et al.
2014/0159043 A1 6/2014 Sakariya et al.
2014/0184667 A1 7/2014 Xu
2014/0217448 A1 8/2014 Kim et al.
2014/0264763 A1 9/2014 Meitl et al.
2014/0267683 A1 9/2014 Bibl et al.
2014/0306248 A1 10/2014 Ahn et al.
2014/0367633 A1 12/2014 Bibl et al.
2014/0367705 A1 12/2014 Bibl et al.
2015/0028362 A1 1/2015 Chan et al.
2015/0135525 A1 5/2015 Bower
2015/0137153 A1 5/2015 Bibl et al.
2015/0169011 A1 6/2015 Bibl et al.
2015/0181148 A1 6/2015 Slovick et al.
2015/0263066 A1 9/2015 Hu et al.
2015/0280066 A1 10/2015 Fujimura et al.
2015/0280089 A1 10/2015 Obata et al.
2015/0302795 A1 10/2015 Genoe
2015/0362165 A1 12/2015 Chu et al.
2015/0371585 A1 12/2015 Bower et al.
2015/0371591 A1 12/2015 Suzuki et al.
2015/0371974 A1 12/2015 Bower et al.
2015/0372051 A1 12/2015 Bower et al.
2015/0372052 A1 12/2015 Bower et al.
2015/0372053 A1 12/2015 Bower et al.
2015/0373793 A1 12/2015 Bower et al.
2016/0005721 A1 1/2016 Bower et al.
2016/0018094 A1 1/2016 Bower et al.
2016/0064363 A1 3/2016 Bower et al.
2016/0093600 A1 3/2016 Bower et al.
2016/0118026 A1 4/2016 Loo et al.
2016/0119565 A1 4/2016 Fujita et al.
2016/0127668 A1 5/2016 Fujita et al.
2016/0163253 A1 6/2016 Chaji et al.
2016/0212361 A1 7/2016 Suzuki
2016/0276326 A1 9/2016 Natarajan et al.
2016/0343771 A1 11/2016 Bower et al.
2017/0040371 A1 2/2017 Izuhara
2017/0047393 A1 2/2017 Bower et al.
2017/0061867 A1 3/2017 Cok et al.
2017/0084671 A1 3/2017 Hack et al.
2017/0154819 A1 6/2017 Bower et al.
2017/0186356 A1 6/2017 Cok
2017/0187976 A1 6/2017 Cok
2017/0188427 A1 6/2017 Cok et al.
2017/0206820 A1 7/2017 Cok et al.
2017/0206845 A1 7/2017 Sakariya et al.
2017/0330509 A1 11/2017 Cok et al.
2017/0338374 A1 11/2017 Zou et al.
2017/0352647 A1 12/2017 Raymond et al.
2018/0131886 A1 5/2018 Cok
2018/0166512 A1 6/2018 Hack et al.
2018/0191978 A1 7/2018 Cok et al.
2018/0197471 A1 7/2018 Rotzoll et al.
2018/0315793 A1 11/2018 Zhu et al.

FOREIGN PATENT DOCUMENTS

WO WO-2006/099741 A1 9/2006
WO WO-2008/103931 A2 8/2008
WO WO-2010/032603 A1 3/2010
WO WO-2010/111601 A2 9/2010
WO WO-2010/132552 A1 11/2010
WO WO-2013/064800 A1 5/2013
WO WO-2013/165124 A1 11/2013
WO WO-2014/121635 A1 8/2014
WO WO-2014/149864 A1 9/2014

OTHER PUBLICATIONS

Cok, R. S. et al., 60.3: AMOLED Displays Using Transfer-Printed Integrated Circuits, Society for Information Display, 10:902-904, (2010).

Feng, X. et al., Competing Fracture in Kinetically Controlled Transfer Printing, Langmuir, 23(25):12555-12560, (2007).

Gent, A.N., Adhesion and Strength of Viscoelastic Solids. Is There a Relationship between Adhesion and Bulk Properties?, American Chemical Society, Langmuir, 12(19):4492-4496, (1996).

Kim, Dae-Hyeong et al., Optimized Structural Designs for Stretchable Silicon Integrated Circuits, Small, 5(24):2841-2847, (2009).

Kim, Dae-Hyeong et al., Stretchable and Foldable Silicon Integrated Circuits, Science, 320:507-511, (2008).

Kim, S. et al., Microstructured elastomeric surfaces with reversible adhesion and examples of their use in deterministic assembly by transfer printing, PNAS, 107(40):17095-17100, (2010).

Kim, T. et al., Kinetically controlled, adhesiveless transfer printing using microstructured stamps, Applied Physics Letters, 94(11):113502-1-113502-3, (2009).

Meitl, M. A. et al., Transfer printing by kinetic control of adhesion to an elastomeric stamp, Nature Material, 5:33-38, (2006).

Michel, B. et al., Printing meets lithography: Soft approaches to high-resolution patterning, J. Res. & Dev. 45(5):697-708, (2001).

Trindade, A.J. et al., Precision transfer printing of ultra-thin AlInGaN micron-size light-emitting diodes, Crown, pp. 217-218, (2012).

(56) References Cited

OTHER PUBLICATIONS

Cok, R. S. et al., AMOLED displays with transfer-printed integrated circuits, Journal of SID, 19(4):335-341 (2011).
Cok, R. S. et al., Inorganic light-emitting diode displays using micro-transfer printing, Journal of the SID, 25(10):589-609, (2017).
Hamer et al., 63.2: AMOLED Displays Using Transfer-Printed Integrated Circuits, SID 09 Digest, 40(2):947-950 (2009).
Lee, S. H. etal, Laser Lift-Offof GaN Thin Film and its Application to the Flexible Light Emitting Diodes, Proc. of SPIE 8460:846011-1-846011-6 (2012).
Roscher, H., VCSEL Arrays with Redundant Pixel Designs for 10Gbits/s 2-D Space-Parallel MMF Transmission, Annual Report, optoelectronics Department, (2005).
Yaniv et al., A 640×480 Pixel Computer Display Using Pin Diodes with Device Redundancy, 1988 International Display Research Conference, IEEE, CH-2678-1/88:152-154 (1988).
Bower, C. A. et al., Micro-Transfer-Printing: Heterogeneous Integration of Microscale Semiconductor Devises using Elastomer Stamps, IEEE Conference, (2014).

* cited by examiner

| Place 4 | Place 3 | Place 2 | Place 1 |
|---|---|---|---|
| 3 | 2 | 5 | 4 |
| Digit 3 | Digit 2 | Digit 1 | Digit 0 |

FIG. 4

| Place 4 | Place 3 | Place 2 | Place 1 |
|---|---|---|---|
| 1 | 0 | 1 | 1 |
| Bit 3 | Bit 2 | Bit 1 | Bit 0 |
| MSB | | | LSB |

FIG. 5

| | | | |
|---|---|---|---|
| 1011 | 1010 | 1100 | 1011 |
| 1100 | 1011 | 1010 | 1101 |
| 1101 | 1110 | 1110 | 1101 |
| 1110 | 1101 | 1100 | 1110 |

FIG. 8

*Bit Plane 0*

| | | | |
|---|---|---|---|
| 1 | 0 | 0 | 1 |
| 0 | 1 | 0 | 1 |
| 1 | 0 | 0 | 1 |
| 0 | 1 | 0 | 0 |

FIG. 9A

*Bit Plane 1*

| | | | |
|---|---|---|---|
| 1 | 1 | 0 | 1 |
| 0 | 1 | 1 | 0 |
| 0 | 1 | 1 | 0 |
| 1 | 0 | 0 | 1 |

FIG. 9B

*Bit Plane 2*

| | | | |
|---|---|---|---|
| 0 | 0 | 1 | 0 |
| 1 | 0 | 0 | 1 |
| 1 | 1 | 1 | 1 |
| 1 | 1 | 1 | 1 |

FIG. 9C

*Bit Plane 3*

| | | | |
|---|---|---|---|
| 1 | 1 | 1 | 1 |
| 1 | 1 | 1 | 1 |
| 1 | 1 | 1 | 1 |
| 1 | 1 | 1 | 1 |

FIG. 9D

BIT-PLANE PULSE WIDTH MODULATED DIGITAL DISPLAY SYSTEM

PRIORITY APPLICATIONS

This application is a continuation of U.S. patent application Ser. No. 15/476,684, filed on Mar. 31, 2017, entitled Bit-Plane Pulse Width Modulated Digital Display System, which is a continuation of U.S. patent application Ser. No. 14/835,282, filed Aug. 25, 2015, entitled Bit-Plane Pulse Width Modulated Digital Display System, the content of which are hereby incorporated by reference in its entirety.

FIELD OF THE INVENTION

The present invention relates to a display systems using digital pixel values driven by pulse-width modulation.

BACKGROUND OF THE INVENTION

Flat-panel displays are widely used in conjunction with computing devices, in portable devices, and for entertainment devices such as televisions. Such displays typically employ a plurality of pixels distributed over a display substrate to display images, graphics, or text. In a color display, each pixel includes light emitters that emit light of different colors, such as red, green, and blue. For example, liquid crystal displays (LCDs) employ liquid crystals to block or transmit light from a backlight behind the liquid crystals and organic light-emitting diode (OLED) displays rely on passing current through a layer of organic material that glows in response to the current. Displays using inorganic light emitting diodes (LEDs) are also in widespread use for outdoor signage and have been demonstrated in a 55-inch television.

Displays are typically controlled with either a passive-matrix (PM) control employing electronic circuitry external to the display substrate or an active-matrix (AM) control employing electronic circuitry formed directly on the display substrate and associated with each light-emitting element. Both OLED displays and LCDs using passive-matrix control and active-matrix control are available. An example of such an AM OLED display device is disclosed in U.S. Pat. No. 5,550,066.

Active-matrix circuits are commonly constructed with thin-film transistors (TFTs) in a semiconductor layer formed over a display substrate and employing a separate TFT circuit to control each light-emitting pixel in the display. The semiconductor layer is typically amorphous silicon or polycrystalline silicon and is distributed over the entire flat-panel display substrate. The semiconductor layer is photolithographically processed to form electronic control elements, such as transistors and capacitors. Additional layers, for example insulating dielectric layers and conductive metal layers are provided, often by evaporation or sputtering, and photolithographically patterned to form electrical interconnections, or wires.

Typically, each display sub-pixel is controlled by one control element, and each control element includes at least one transistor. For example, in a simple active-matrix organic light-emitting diode (OLED) display, each control element includes two transistors (a select transistor and a power transistor) and one capacitor for storing a charge specifying the luminance of the sub-pixel. Each OLED element employs an independent control electrode connected to the power transistor and a common electrode. In contrast, an LCD typically uses a single transistor to control each pixel. Control of the light-emitting elements is usually provided through a data signal line, a select signal line, a power connection and a ground connection. Active-matrix elements are not necessarily limited to displays and can be distributed over a substrate and employed in other applications requiring spatially distributed control.

Liquid crystals are readily controlled by a voltage applied to the single control transistor. In contrast, the light output from both organic and inorganic LEDs is a function of the current that passes through the LEDs. The light output by an LED is generally linear in response to current but is very non-linear in response to voltage. Thus, in order to provide a well-controlled LED, it is preferred to use a current-controlled circuit to drive each of the individual LEDs in a display. Furthermore, inorganic LEDs typically have variable efficiency at different current, voltage, or luminance levels. It is therefore more efficient to drive the inorganic LED with a particular desired constant current.

Pulse width modulation (PWM) schemes control luminance by varying the time during which a constant current is supplied to a light emitter. A fast response to a pulse is desirable to control the current and provide good temporal resolution for the light emitter. However, capacitance and inductance inherent in circuitry on a light-emitter substrate can reduce the frequency with which pulses can be applied to a light emitter. This problem is sometimes addresses by using pre-charge current pulses on the leading edge of the driving waveform and sometimes a discharge pulse on the trailing edge of the waveform. However, this increases power consumption in the system and can, for example, consume approximately half of the total power for controlling the light emitters.

Pulse-width modulation is used to provide dimming for light-emissive devices such as back-light units in liquid crystal displays. For example, U.S. Patent Publication No. 20080180381 describes a display apparatus with a PWM dimming control function in which the brightness of groups of LEDs in a backlight are controlled to provide local dimming and thereby improve the contrast of the LCD.

OLED displays are also known to include PWM control, for example as taught in U.S. Patent Publication No. 2011/0084993. In this design, a storage capacitor is used to store the data value desired for display at the pixel. A variable-length control signal for controlling a drive transistor with a constant current is formed by a difference between the analog data value and a triangular wave form. However, this design requires a large circuit and six control signals, limiting the display resolution for a thin-film transistor backplane.

U.S. Pat. No. 7,738,001 describes a passive-matrix control method for OLED displays. By comparing a data value to a counter a binary control signal indicates when the pixel should be turned on. This approach requires a counter and comparison circuit for each pixel in a row and is only feasible for passive-matrix displays. U.S. Pat. No. 5,731,802 describes a passive-matrix control method for displays. However, large passive-matrix displays suffer from flicker.

U.S. Pat. No. 5,912,712 discloses a method for expanding a pulse width modulation sequence to adapt to varying video frame times by controlling a clock signal. This design does not use pulse width modulation for controlling a display pixel.

There remains a need, therefore, for an active-matrix display system that provides an efficient, constant current drive signal to a light emitter and has a high resolution.

SUMMARY OF THE INVENTION

The present invention is, among various embodiments, a digital-drive display system or, more succinctly, a digital display. An array of display pixels is arranged, for example on a display substrate. Each display pixel includes a light emitter, a digital memory for storing a digital pixel value, and a drive circuit that drives the light emitter in response to the digital pixel value. The drive circuit can provide a voltage or a current in response to the value of the digital pixel value. Alternatively, the drive circuit provides a constant current source that is supplied to the light emitter for a time period corresponding to the digital pixel value.

Constant current sources are useful for driving LEDs because LEDs typically are most efficient within a limited range of currents so that a temporally varied constant current drive is more efficient than a variable current or variable voltage drive. However, conventional schemes for providing temporal control, for example pulse width modulation, are generally employed in passive-matrix displays which suffer from flicker and are therefore limited to relatively small displays. A prior-art constant-current drive used in an OLED active-matrix display requires analog storage and complex control schemes with relatively large circuits and many control signals to provide a temporal control, limiting the density of pixels on a display substrate.

The present invention addresses these limitations by providing digital storage for a digital pixel value at each display pixel location. Digital storage is not practical for conventional flat-panel displays that use thin-film transistors because the thin-film circuits required for digital pixel value storage are much too large to achieve desirable display resolution. However, according to the present invention, small micro transfer printed integrated circuits (chiplets) having a crystalline semiconductor substrate can provide small, high-performance digital pixel value storage circuits and temporally controlled constant-current LED drive circuits in a digital display with practical resolution. Such a display has excellent resolution because the chiplets are very small, has excellent efficiency by using constant-current drive for LEDs, and has reduced flicker by using an active-matrix control structure.

In further embodiments of the present invention, display pixels are repeatedly loaded with different bit-planes of the digital pixel values to provide arbitrary bit depth and gray-scale resolution. A control signal provided by a display controller or a pixel controller enables light output from the light emitters in each display pixel for a period corresponding to the bit-plane loaded into the array of display pixels.

In one aspect, the disclosed technology includes a digital-drive display system, including an array of display pixels, each display pixel having a light emitter, a digital memory for storing a digital pixel value, and a drive circuit that drives the light emitter to emit light in response to the digital pixel value stored in the digital memory.

In certain embodiments, the drive circuit provides a voltage or a current corresponding to the value of the stored digital pixel value.

In certain embodiments, the drive circuit provides a constant current that is supplied to the light emitter for a time period corresponding to the value of the stored digital pixel value.

In certain embodiments, the time period is formed with a counter controlled by a clock signal.

In certain embodiments, different display pixels in the array of display pixels have clock signals that are out of phase.

In certain embodiments, the light emitter is an inorganic light-emitting diode or an organic light-emitting diode.

In certain embodiments, the light emitter is a red light emitter that emits red light and comprising a blue light emitter that emits blue light and a green light emitter that emits green light, wherein the digital memory stores a red digital pixel value, a green digital pixel value, and a blue digital pixel value, and wherein the drive circuit drives the red, green, and blue light emitters to emit light in response to the corresponding red, green, and blue digital pixel values stored in the digital memory.

In certain embodiments, the display system includes a display substrate on which the array of display pixels is disposed and wherein the light emitter comprises a light-emitter substrate and wherein the display substrate is separate and distinct from the light-emitter substrate.

In certain embodiments, the display system includes a pixel controller having a pixel substrate on or in which the digital memory and the drive circuit are formed and wherein the pixel substrate is separate and distinct from the light-emitter substrate and the display substrate.

In certain embodiments, for each pixel, the digital memory is a digital digit memory for storing at least one digit of a multi-digit digital pixel value, and the drive circuit drives the light emitter to emit light when the digit memory stores a non-zero digit value and a control signal for the respective pixel is enabled.

In certain embodiments, the multi-digit digital pixel value is a binary value, the digit places correspond to powers of two, and the period of time corresponding to a digit place is equal to two raised to the power of the digit place minus one times a predetermined digit period ((2**(digit place−1))*digit period) and a frame period is equal to two raised to the power of the digit place times the predetermined digit period ((2**(digit place))*digit period).

In certain embodiments, the multi-digit digital pixel value is an 8-bit value, a 9-bit value, a 10-bit value, an 11-bit value, a 12-bit value, a 13-bit value, a 14-bit value, a 15-bit value, or a 16-bit value.

In certain embodiments, the digit memory is a one-bit memory.

In certain embodiments, the display system includes a display controller for controlling the display pixels that comprises a loading circuit for loading at least one digit of the multi-digit digital pixel value in the digit memory of each display pixel and a control circuit for controlling a control signal connected to each display pixel in common.

In certain embodiments, the display system includes a color image having pixels comprising different colors and a multi-digit digital pixel value for each color of each pixel in the image, wherein each display pixel in the array of display pixels comprises a color light emitter for each of the different colors that emits light of the corresponding color, a digit memory for storing at least one digit of a digital pixel value for each of the different colors, and a drive circuit for each of the different colors that drives each color of light emitter to emit light when the corresponding digit memory stores a non-zero digit value and the control signal is enabled.

In certain embodiments, the loading circuit comprises circuitry that loads the digit of the same digit place of each digital pixel value for each of the different colors before enabling the control signal for a period of time corresponding to the digit place of the loaded digits.

In certain embodiments, the loading circuit comprises circuitry for independently loading the digit memories for each of the different colors in a sequence or in parallel.

In certain embodiments, the digit memories for each of the different colors in each display pixel are connected in a serial shift register and the loading circuit comprises circuitry for serially shifting a digit of each multi-digit digital pixel value for each of the different colors into the digit memories of each display pixel.

In certain embodiments, the different colors are red, green, and blue.

In certain embodiments, the digit memory comprises a red, a green, and a blue one-bit memory, each one-bit memory storing a digit of a corresponding red, green, or blue multi-digit digital pixel value.

In certain embodiments, the loading circuit comprises circuitry for loading the different digits of the multi-digit digital pixel value in ascending or descending digit-place order.

In certain embodiments, the loading circuit comprises circuitry for loading the different digits of the multi-digit digital pixel value in a scrambled digit-place order that is neither ascending nor descending.

In certain embodiments, the loading circuit comprises circuitry for repeatedly loading a digit of each multi-digit digital pixel value into a corresponding display pixel and the control circuit enables the control signal for each of the repeated loadings for the period of time divided by the number of times the digit is repeatedly loaded, wherein the loading circuit comprises circuitry for loading a different digit of the multi-digit digital pixel value into a corresponding display pixel between the repeated loadings of the digit.

In certain embodiments, each of the light emitters has a width from 2 to 5 μm, 5 to 10 μm, 10 to 20 μm, or 20 to 50 μm.

In certain embodiments, each of the light emitters has a length from 2 to 5 μm, 5 to 10 μm, 10 to 20 μm, or 20 to 50 μm.

In certain embodiments, each of the light emitters has with a height from 2 to 5 μm, 4 to 10 μm, 10 to 20 μm, or 20 to 50 μm.

In certain embodiments, the display system includes a display substrate.

In certain embodiments, the display substrate has a thickness from 5 to 10 microns, 10 to 50 microns, 50 to 100 microns, 100 to 200 microns, 200 to 500 microns, 500 microns to 0.5 mm, 0.5 to 1 mm, 1 mm to 5 mm, 5 mm to 10 mm, or 10 mm to 20 mm.

In certain embodiments, display substrate has a transparency greater than or equal to 50%, 80%, 90%, or 95% for visible light.

In certain embodiments, the display substrate has a contiguous display substrate area, the plurality of light emitters each have a light-emissive area, and the combined light-emissive areas of the plurality of light emitters is less than or equal to one-quarter of the contiguous display substrate area.

In certain embodiments, the combined light-emissive areas of the plurality of light emitters is less than or equal to one eighth, one tenth, one twentieth, one fiftieth, one hundredth, one five-hundredth, one thousandth, one two-thousandth, or one ten-thousandth of the contiguous display substrate area.

In certain embodiments, display substrate has a transparency greater than or equal to 50%, 80%, 90%, or 95% for visible light.

In certain embodiments, the display substrate is a member selected from the group consisting of polymer, plastic, resin, polyimide, PEN, PET, metal, metal foil, glass, a semiconductor, and sapphire.

In certain embodiments, the display substrate is flexible.

In certain embodiments, the drive circuit provides a voltage corresponding to the value of the stored digital pixel value.

In certain embodiments, a current corresponding to the value of the stored digital pixel value.

In certain embodiments, the light emitter is an inorganic light-emitting diode.

In another aspect, the disclosed technology includes a method for controlling a digital display system, including: providing an array of display pixels; providing a display controller for receiving an image having a digital pixel value for each image pixel in the image, each image pixel corresponding to a display pixel; and the display controller for loading the digital pixel values into the digital memory of the corresponding display pixel so that the drive circuit drives the light emitter to emit light in response to the digital pixel value stored in the digital memory.

In another aspect, the disclosed technology includes a method for controlling a digital display system, including: providing an array of display pixels and a display controller; the display controller receiving an image having a multi-digit digital pixel value for each image pixel in the image, each image pixel corresponding to a display pixel; and the display controller repeatedly loading a different digit of each image pixel value into a corresponding display pixel and enabling the control signal for a period of time corresponding to the digit place of the loaded digit until all of the digits in the image pixel value have been loaded and enabled.

In certain embodiments, the image is a color image having pixels comprising different colors and a multi-digit digital pixel value for each color of each pixel in the image; and each display pixel in the array of display pixels comprises a color light emitter for each of the different colors that emits light of the corresponding color, a digit memory for storing at least one digit of a multi-digit digital pixel value for each of the different colors, and a drive circuit for each of the different colors that drives each color of light emitter when the corresponding digit memory stores a non-zero digit value and the control signal is enabled.

In certain embodiments, the display controller loads the digit of the same digit place of each digital pixel value for each of the different colors before enabling the control signal for a period of time corresponding to the digit place of the loaded digits.

In certain embodiments, the digit memories for each of the different colors are independently loaded in a sequence or in parallel.

In certain embodiments, the digit memories for each of the different colors in each display pixel are connected in a serial shift register and a digit for each digital image pixel value for each of the different colors is serially sifted into the digit memories of each display pixel.

In certain embodiments, the different colors are at red, green, and blue.

In certain embodiments, the digit memory comprises a red, a green, and a blue one-bit memory, each memory storing a digit of a corresponding red, green, or blue multi-digit digital pixel value.

In certain embodiments, the different digits are loaded in ascending or descending digit-place order.

In certain embodiments, the different digits are loaded in a scrambled digital-place order that is neither ascending nor descending.

In certain embodiments, a digit of each image pixel value is repeatedly loaded into a corresponding display pixel and the control signal is enabled for each of the repeated loadings for the period of time divided by the number of times the digit is repeatedly loaded, and a different digit of each image pixel value is loaded into a corresponding display pixel between the repeated loadings of the digit.

In certain embodiments, the image is a two-dimensional image and the display controller loads all of the image pixel values into the array of display pixels before enabling the control signal.

In certain embodiments, the image is a row of a two-dimensional image and the display controller loads the row into the array of display pixels before enabling the control signal.

In certain embodiments, the display pixels are arranged in rows and at least one row of display pixels is loaded or enabled out of phase with another row of display pixels.

In another aspect, the disclosed technology includes a pixel circuit for a digital display system, including a light emitter, a digital digit memory for storing at least one digit of a digital pixel value, a control signal, and a drive circuit that drives the light emitter when the digit memory stores a non-zero digit value and the control signal is enabled.

In certain embodiments, the pixel circuit includes a counter responsive to the stored digital pixel value, the counter generating a control signal enabling light output for a period of time corresponding to the digital pixel value.

In certain embodiments, the counter comprises output counter values representing the digital value stored in the counter and comprising an OR logic circuit combining the output counter values of the counter to provide the control signal enabling light output for a period of time corresponding to the digital pixel value.

In another aspect, the disclosed technology includes a method of micro assembling a digital-drive display system, the method including: providing a display substrate; and micro transfer printing the plurality of printable light emitters onto a display substrate to form an array of display pixels, wherein each display pixel having a light emitter, a digital memory for storing a digital pixel value, and a drive circuit that drives the light emitter to emit light in response to the digital pixel value stored in the digital memory.

In certain embodiments, the method includes micro transfer printing the digital memory for each pixel onto the display substrate.

In certain embodiments, the method includes micro transfer printing the drive circuit for each pixel onto the display substrate.

In certain embodiments, each pixel comprises a red printed micro inorganic light-emitting diode, a green printed micro inorganic light-emitting diode, and a blue printed micro inorganic light-emitting diode.

In certain embodiments, the display substrate is non-native to the plurality of printable micro LEDs.

In certain embodiments, the drive circuit provides a voltage or a current corresponding to the value of the stored digital pixel value.

In certain embodiments, the drive circuit provides a constant current that is supplied to the light emitter for a time period corresponding to the value of the stored digital pixel value.

In certain embodiments, the time period is formed with a counter controlled by a clock signal.

In certain embodiments, different display pixels in the array of display pixels have clock signals that are out of phase.

In certain embodiments, the light emitter is an inorganic light-emitting diode or an organic light-emitting diode.

In certain embodiments, the light emitter is an inorganic light-emitting diode.

In certain embodiments, the light emitter is a red light emitter that emits red light and comprising a blue light emitter that emits blue light and a green light emitter that emits green light, wherein the digital memory stores a red digital pixel value, a green digital pixel value, and a blue digital pixel value, and wherein the drive circuit drives the red, green, and blue light emitters to emit light in response to the corresponding red, green, and blue digital pixel values stored in the digital memory.

In certain embodiments, the light emitter comprises a light-emitter substrate and wherein the display substrate is separate and distinct from the light-emitter substrate.

In certain embodiments, the display system comprises a pixel controller having a pixel substrate on or in which the digital memory and the drive circuit are formed and wherein the pixel substrate is separate and distinct from the light-emitter substrate and the display substrate.

In certain embodiments, for each pixel, the digital memory is a digital digit memory for storing at least one digit of a multi-digit digital pixel value, and the drive circuit drives the light emitter to emit light when the digit memory stores a non-zero digit value and a control signal for the respective pixel is enabled.

In certain embodiments, the multi-digit digital pixel value is a binary value, the digit places correspond to powers of two, and the period of time corresponding to a digit place is equal to two raised to the power of the digit place minus one times a predetermined digit period ((2**(digit place−1))*digit period) and a frame period is equal to two raised to the power of the digit place times the predetermined digit period ((2**(digit place))*digit period).

In certain embodiments, the multi-digit digital pixel value is an 8-bit value, a 9-bit value, a 10-bit value, an 11-bit value, a 12-bit value, a 13-bit value, a 14-bit value, a 15-bit value, or a 16-bit value.

In certain embodiments, the digit memory is a one-bit memory.

In certain embodiments, the display system comprises a display controller for controlling the display pixels that comprises a loading circuit for loading at least one digit of the multi-digit digital pixel value in the digit memory of each display pixel and a control circuit for controlling a control signal connected to each display pixel in common.

In certain embodiments, each display pixel in the array of display pixels comprises a color light emitter for each of the different colors that emits light of the corresponding color, a digit memory for storing at least one digit of a digital pixel value for each of the different colors, and a drive circuit for each of the different colors that drives each color of light emitter to emit light when the corresponding digit memory stores a non-zero digit value and the control signal is enabled.

In certain embodiments, the loading circuit comprises circuitry that loads the digit of the same digit place of each digital pixel value for each of the different colors before enabling the control signal for a period of time corresponding to the digit place of the loaded digits.

In certain embodiments, the loading circuit comprises circuitry for independently loading the digit memories for each of the different colors in a sequence or in parallel.

In certain embodiments, the digit memories for each of the different colors in each display pixel are connected in a serial shift register and the loading circuit comprises circuitry for serially shifting a digit of each multi-digit digital pixel value for each of the different colors into the digit memories of each display pixel.

In certain embodiments, the different colors are red, green, and blue.

In certain embodiments, the digit memory comprises a red, a green, and a blue one-bit memory, each one-bit memory storing a digit of a corresponding red, green, or blue multi-digit digital pixel value.

In certain embodiments, the loading circuit comprises circuitry for loading the different digits of the multi-digit digital pixel value in ascending or descending digit-place order.

In certain embodiments, the loading circuit comprises circuitry for loading the different digits of the multi-digit digital pixel value in a scrambled digit-place order that is neither ascending nor descending.

In certain embodiments, the loading circuit comprises circuitry for repeatedly loading a digit of each multi-digit digital pixel value into a corresponding display pixel and the control circuit enables the control signal for each of the repeated loadings for the period of time divided by the number of times the digit is repeatedly loaded, wherein the loading circuit comprises circuitry for loading a different digit of the multi-digit digital pixel value into a corresponding display pixel between the repeated loadings of the digit.

In certain embodiments, the display substrate has a thickness from 5 to 10 microns, 10 to 50 microns, 50 to 100 microns, 100 to 200 microns, 200 to 500 microns, 500 microns to 0.5 mm, 0.5 to 1 mm, 1 mm to 5 mm, 5 mm to 10 mm, or 10 mm to 20 mm.

In certain embodiments, display substrate has a transparency greater than or equal to 50%, 80%, 90%, or 95% for visible light.

In certain embodiments, the display substrate has a contiguous display substrate area, the plurality of light emitters each have a light-emissive area, and the combined light-emissive areas of the plurality of light emitters is less than or equal to one-quarter of the contiguous display substrate area.

In certain embodiments, the combined light-emissive areas of the plurality of light emitters is less than or equal to one eighth, one tenth, one twentieth, one fiftieth, one hundredth, one five-hundredth, one thousandth, one two-thousandth, or one ten-thousandth of the contiguous display substrate area.

In certain embodiments, display substrate has a transparency greater than or equal to 50%, 80%, 90%, or 95% for visible light.

In certain embodiments, the display substrate is a member selected from the group consisting of polymer, plastic, resin, polyimide, PEN, PET, metal, metal foil, glass, a semiconductor, and sapphire.

In certain embodiments, the display substrate is flexible.

In certain embodiments, each pixel includes: a printed micro-system of a plurality of printed micro-systems disposed on the display substrate, each printed micro-system of the plurality of printed micro-systems including: a pixel substrate of a plurality of pixel substrates on which the printed micro inorganic light-emitting diodes for a respective pixel are disposed, and a fine interconnection having a width of 100 nm to 1 μm electrically connected to the light emitter for the respective pixel.

In certain embodiments, the method includes micro transfer printing a pixel controller having a pixel substrate on or in which the digital memory and the drive circuit are formed onto the display substrate, wherein the pixel substrate is separate and distinct from the light-emitter substrate and the display substrate.

In certain embodiments, the method includes micro transfer printing a display controller onto the display substrate for controlling the display pixels that comprises a loading circuit for loading at least one digit of the multi-digit digital pixel value in the digit memory of each display pixel and a control circuit for controlling a control signal connected to each display pixel in common.

In certain embodiments, each light emitter has a width from 2 to 5 μm, 5 to 10 μm, 10 to 20 μm, or 20 to 50 μm.

In certain embodiments, each light emitter has a length from 2 to 5 μm, 5 to 10 μm, 10 to 20 μm, or 20 to 50 μm.

In certain embodiments, each light emitter has a height from 2 to 5 μm, 4 to 10 μm, 10 to 20 μm, or 20 to 50 μm.

BRIEF DESCRIPTION OF THE DRAWINGS

The foregoing and other objects, aspects, features, and advantages of the present disclosure will become more apparent and better understood by referring to the following description taken in conjunction with the accompanying drawings, in which:

FIGS. 4 and 5 illustrate digits and places for representations of digital pixel values;

FIG. 8 illustrates an array of binary digital pixel values;

FIGS. 9A-9D illustrate bit-planes corresponding to the array of binary digital pixel values in FIG. 8;

Figure 1:
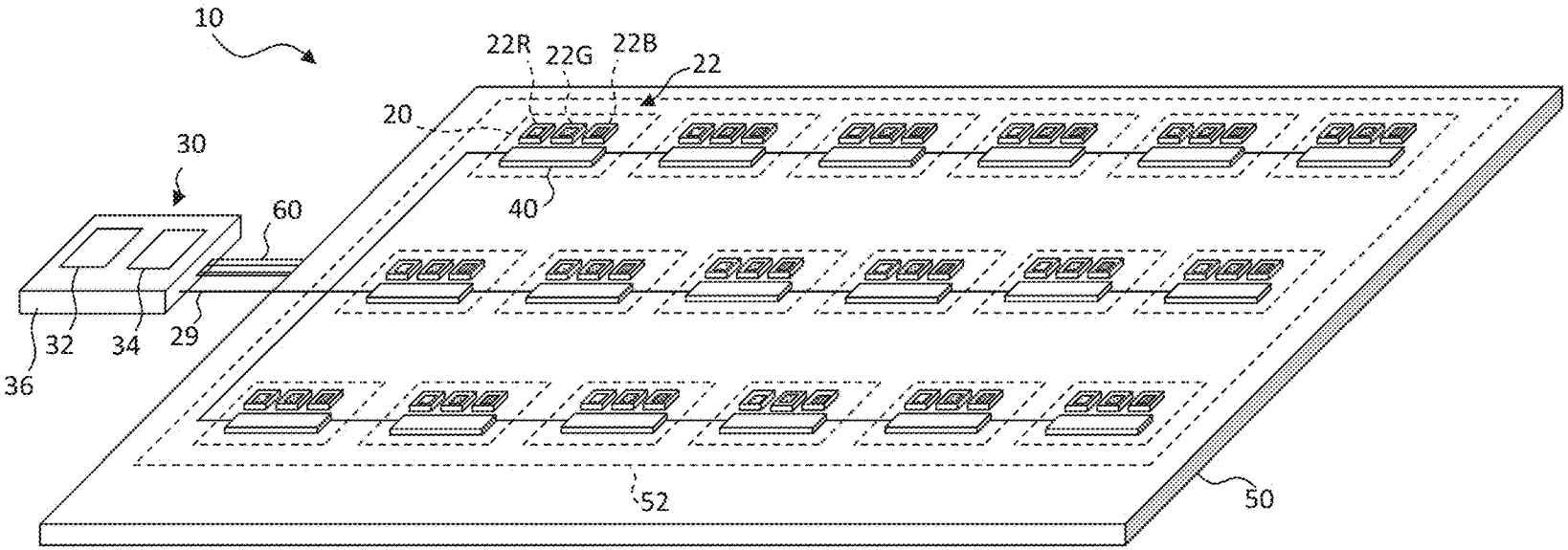
FIG. 1 is a schematic perspective of an embodiment of the present invention.

The features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The figures are not drawn to scale since the variation in size of various elements in the Figures is too great to permit depiction to scale.

DETAILED DESCRIPTION OF THE INVENTION

Figure 2:
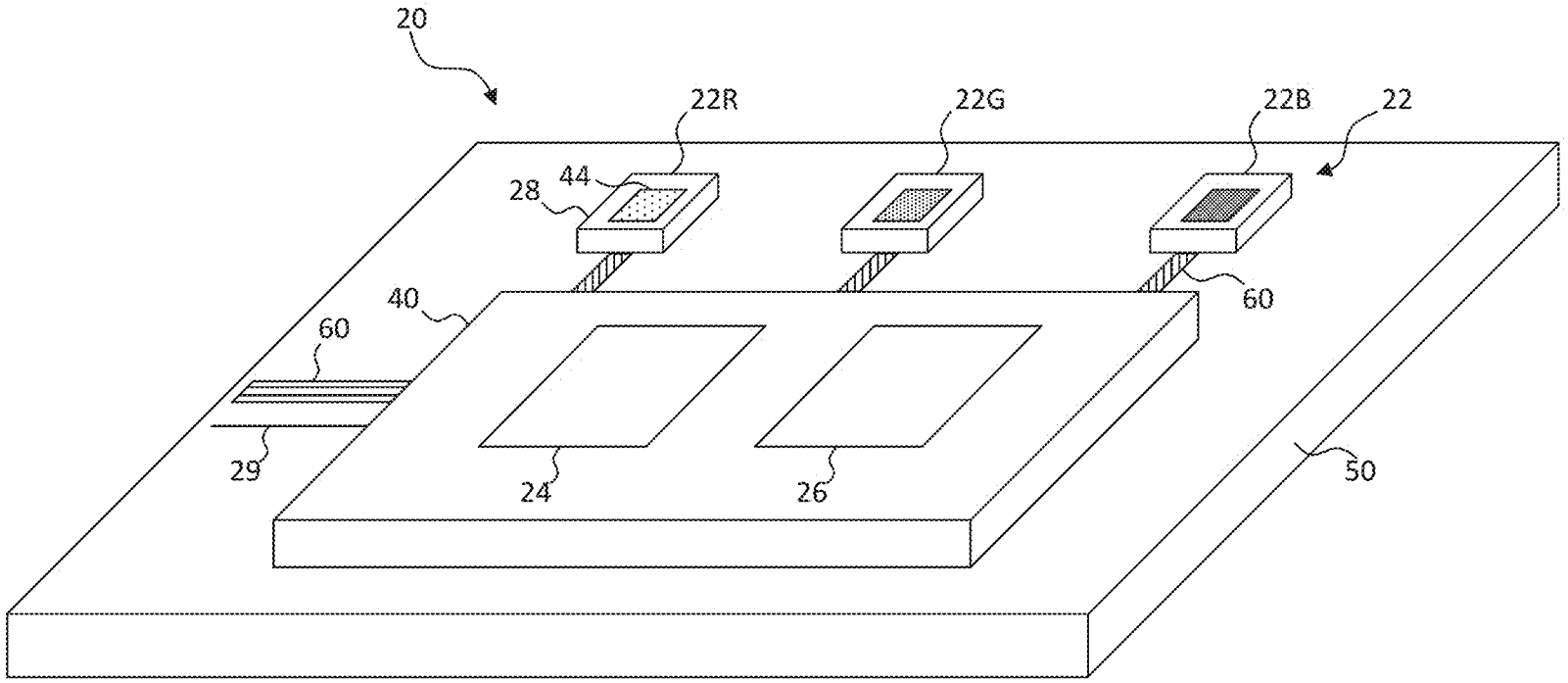
FIG. 2 is a more detailed schematic perspective of the embodiment of FIG. 1.

Referring to the perspective illustration of FIG. 1 and the corresponding detailed perspective of FIG. 2, a digital-drive display system 10 includes an array of display pixels 20. Each display pixel 20 has one or more light emitters 22, a digital memory 24 for storing one or more digital pixel values, and a drive circuit 26 that drives the light emitter(s) 22 to emit light in response to the digital pixel value(s) stored in the digital memory 24. The digital memory 24 and drive circuit 26 can be provided in a pixel controller 40. In various embodiments of the present invention, the drive circuit 26 provides a voltage or a current corresponding to the value of the stored digital pixel value(s) to drive the light emitter(s) 22 to emit light. In another embodiment, the drive circuit 26 provides a constant current that is supplied to the light emitter(s) 22 for a time period corresponding to the value of the stored digital pixel value(s) to drive the light emitter(s) 22 to emit light.

In embodiments of the present invention, the light emitter 22 is an inorganic light-emitting diode or an organic light-emitting diode. When the display pixels 20 include multiple light emitters 22, the light emitters 22 can be a red light emitter 22R that emits red light, a blue light emitter 22B that emits blue light, and a green light emitter 22G that emits green light. The digital memory 24 can store a red digital pixel value, a green digital pixel value, and a blue digital pixel value and the drive circuit 26 can drive the red, green, and blue light emitters 22R, 22G, 22B to each emit colored light in response to the corresponding red, green, and blue digital pixel values stored in the digital memory 24.

In an embodiment of the present invention, the array of display pixels 20 is disposed on a display substrate 50. Each light emitter 22 includes a light-emitter substrate 28. The display substrate 50 can be separate and distinct from the light-emitter substrates 28. The light-emitter substrates 28 can be native substrates, that is the light emitters 22 (for example inorganic micro light-emitter diodes) can be constructed on or in a semiconductor wafer, for example a GaN semiconductor formed on a sapphire substrate, separated from the wafer, and disposed on the display substrate 50, for example by micro transfer printing. The display substrate 50 is thus non-native to the light-emitter substrates 28. Similarly, the digital memory 24 and the drive circuit 26 in each display pixel 20 can be formed in a pixel controller 40 integrated circuit, for example a chiplet having a silicon pixel substrate using CMOS processes and designs to implement digital logic circuits and drive transistor circuits. Such materials and processes can form small, efficient, and fast circuits that are not available in thin-film transistor circuits, enabling additional functionality in the display pixels 20 of the present invention, in particular digital storage and logic circuits.

The pixel controller 40 can be formed in or on a substrate that is separate and distinct from the light-emitter substrate 28 and the display substrate 50. As with the light emitters 22, the pixel controller 40 can be constructed on or in a semiconductor wafer, for example a silicon semiconductor wafer, separated from the wafer, and disposed on the display substrate 50, for example by micro transfer printing. The light emitters 22 and the pixel controller 40 can be interconnected with wires 60 (not shown on the display substrate 50 in FIGS. 1 and 2). Semiconductor wafers, light emitters 22, pixel controllers 40, and interconnecting wires 60 can be made using photolithographic and integrated circuit materials and processes known in the integrated circuit and flat-panel display arts.

Figure 3:
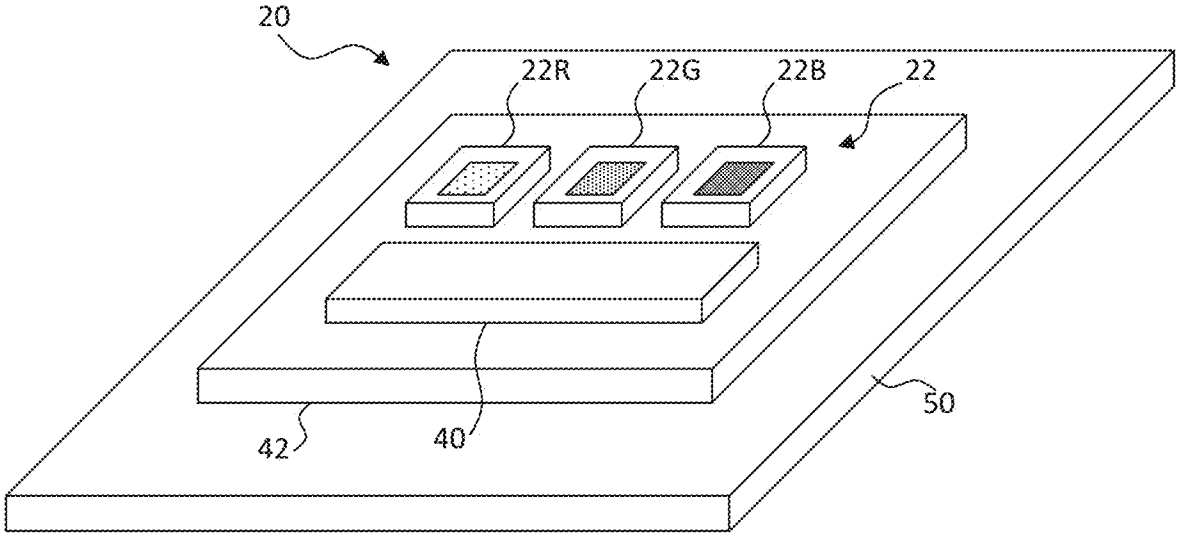
FIG. 3 is a schematic perspective according to an embodiment of the present invention having a pixel substrate.

In an alternative embodiment, referring to FIG. 3, the light emitters 22 and the pixel controller 40 are disposed on a pixel substrate 42 that is separate and distinct from the display substrate 50 and separate and distinct from the light-emitter substrates 28 and the pixel controller 40 substrate. In yet another embodiment, the digital memory 24 and the drive circuit 26 are formed in or on and are native to the pixel substrate 42 and the light emitters 22 are disposed on the pixel substrate 42 (i.e., the substrate of the pixel controller 40 is the pixel substrate 42, as described above). In either case, the pixel substrate 42 is then disposed, for example by micro transfer printing or vacuum pick-and-place tools, on the display substrate 50.

The array of display pixels 20 can be controlled through the wires 60 by a display controller 30. The display controller 30 can be one or more integrated circuits and can, for example, include an image frame store, digital logic, input and output data signal circuits, and input and output control signal circuits such as loading circuits 32, control circuits 34, and a control signal 29. The loading circuit 32 can include row select lines and column drivers for providing sequential rows of digital pixel values to corresponding selected rows of display pixels 20. The display controller 30 can include an image frame store memory for storing digital pixel and calibration values. The display controller 30 can have a display controller substrate 36 separate and distinct from the display substrate 50 that is mounted on the display substrate 50 or is separate from the display substrate 50 (as shown in FIG. 1) and connected to it by wires 60, for example with ribbon cables, flex connectors, or the like.

The digital-drive display system 10 of the present invention can be operated by first providing an array of display pixels 20 and a display controller 30 as described above. The display controller 30 receives an image having a digital pixel value for each image pixel in the image. Each image pixel corresponds to a display pixel 20. The display controller 30 loads the digital pixel values into the digital memory 24 of the corresponding display pixel 20 using the loading circuit 32 and the control circuit 34 so that the drive circuit 26 of the display pixel 20 drives each light emitter 22 to emit light in response to the digital pixel value stored in the digital memory 24. The digital pixel values from successive images can be loaded as successive frames in an image sequence.

In a further embodiment of the present invention, each display pixel 20 includes a control signal 29, the digital memory 24 is a digital digit memory 24 for storing at least one digit of a multi-digit digital pixel value, and the drive circuit 26 drives the light emitter(s) 22 to emit light when the digit memory 24 stores a non-zero digit value and the control signal 29 is enabled. The control signals 29 for different display pixels 20 can be out of phase to reduce the instantaneous current flow through the control signal 29 wires on the display substrate 50 and to reduce synchronous flicker in the light emitters 22. The control signal 29 can be a digital signal provided by digital logic in the control circuit 34 of the display controller 30. Therefore, in an embodiment of the present invention, a pixel circuit for a digital display system 10 includes a light emitter 22, a digital digit memory 24 for storing at least one digit of a digital pixel value, a control signal 29, and a drive circuit 26 that drives the light emitter 22 when the digit memory 24 stores a non-zero digit value and the control signal 29 is enabled.

In an embodiment of the present invention, the multi-digit digital pixel value is a binary value, the digit places correspond to powers of two, and the period of time corresponding to a digit place is equal to two raised to the power of the digit place minus one times a predetermined digit period ((2**(digit place−1))*digit period) and a frame period is equal to two raised to the power of the digit place times the predetermined digit period ((2**(digit place))*digit period). In various embodiments, the multi-digit digital pixel value is a 6-bit value, an 8-bit value, a 9-bit value, a 10-bit value, an 11-bit value, a 12-bit value, a 13-bit value, a 14-bit value, a 15-bit value, or a 16-bit value.

Referring to FIG. 4 in an illustrative four-digit base 10 example, the number 3254 (three thousand two hundred fifty four) has four digit places, each digit place corresponding to a digit in the number 3254 and conventionally ordered from right to left to represent powers of 10 (i.e., 1, 10, 100, and 1000). Each digit of the number 3254 is in one place and is labeled digit 0, digit 1, digit 2, and digit 3. (The numbering arbitrarily begins with zero as is conventional in binary computer science practice.)

FIG. 5 illustrates a binary four-digit example. The binary number 1011 has four places (representing powers of two, i.e., 1, 2, 4, 8) and corresponding bits, labeled bit 0, bit 1, bit 2, and bit 3. As is conventional, the lowest value digit place (the one's place) is the least significant bit (LSB) representing the number of ones in the binary value and the highest value digit place (the eight's place) is the most significant bit (MSB) representing the number of eights in the binary value. For convenience, the remainder of the discussion below addresses binary systems, although the present invention is not limited to binary systems. Thus, a digit place is also called a bit place, a digit is also called a bit, and a digit period is also a bit period.

In binary system with a four-digit value, therefore, the time period corresponding to the first bit place (the ones value) is one bit period, the period corresponding to the second bit place (the twos value) is two bit periods, the period corresponding to the third bit place (the fours value) is four bit periods, and the period corresponding to the fourth bit place (the eights value) is eight bit periods. The bit periods increase by successive powers of two for successive bits in numbers with successively more bits, for example, 8, 9, 10, 11, 12, 13, 14, 15, and 16 bits.

In various embodiment of the present invention, the digit memory 24 is a multi-bit memory with various numbers of bits. In one embodiment, the digit memory 24 is a one-bit memory, for example a digital latch or D flip-flop. Correspondingly, the display controller 30 can include a loading circuit 32 for loading at least one digit of a multi-digit digital pixel value in the digit memory 24 of each display pixel 20 and can include a control circuit 34 for controlling a control signal 29 connected in common to each display pixel 20. When the control signal 29 is enabled, the drive circuit 26 of each display pixel 20 drives a corresponding light emitter 22 to emit light according to the bit value stored in the digit memory 24. If the control signal 29 is enabled and the bit value is a one, light is emitted, for example at the constant current pre-selected for the light emitter 22. If the control signal 29 is enabled, and the bit value is a zero, no light is emitted. If the control signal 29 is not enabled, no light is emitted, regardless of the bit value stored in the digit memory 24. The control signal 29 is enabled for a period of time corresponding to the bit place of the bit value stored in the digit memory 24. If, as described above, a counter 70 is provided in each display pixel 20 (shown in FIG. 13 discussed below), the control signal 29 is generated within the display pixel 20 and the external control signal 29 is not required, although a clock signal to drive the counter 70 is necessary.

In embodiments of the present invention, the digital-drive display 10 is a color display that displays color images having pixels including different colors and a multi-digit digital pixel value for each color of each pixel in the image. In such embodiments, each display pixel 20 in the array of display pixels 20 includes a color light emitter 22 for each of the different colors that emits light of the corresponding color, a digit memory 24 for storing at least one digit of a digital pixel value for each of the different colors, and a drive circuit 26 for each of the different colors that drives each color of light emitter 22 to emit light when the corresponding digit memory 24 stores a non-zero digit value and the control signal 29 is enabled. (Each digital storage element, such as a D flip-flop, can be considered a separate digit memory 24 or all of the digital storage elements together can be considered a single digital memory 24 with multiple storage elements.) In an embodiment, the different colors are at least red, green, and blue but are not limited to red, green, or blue. Primary and other colors can also or alternatively be included. A color digital-drive display system 10 having red, green, and blue colors is shown in FIGS. 1-3 having red light emitters 22R for emitting red light, green light emitters 22G for emitting green light, and blue light emitters 22B for emitting blue light.

Figure 6:
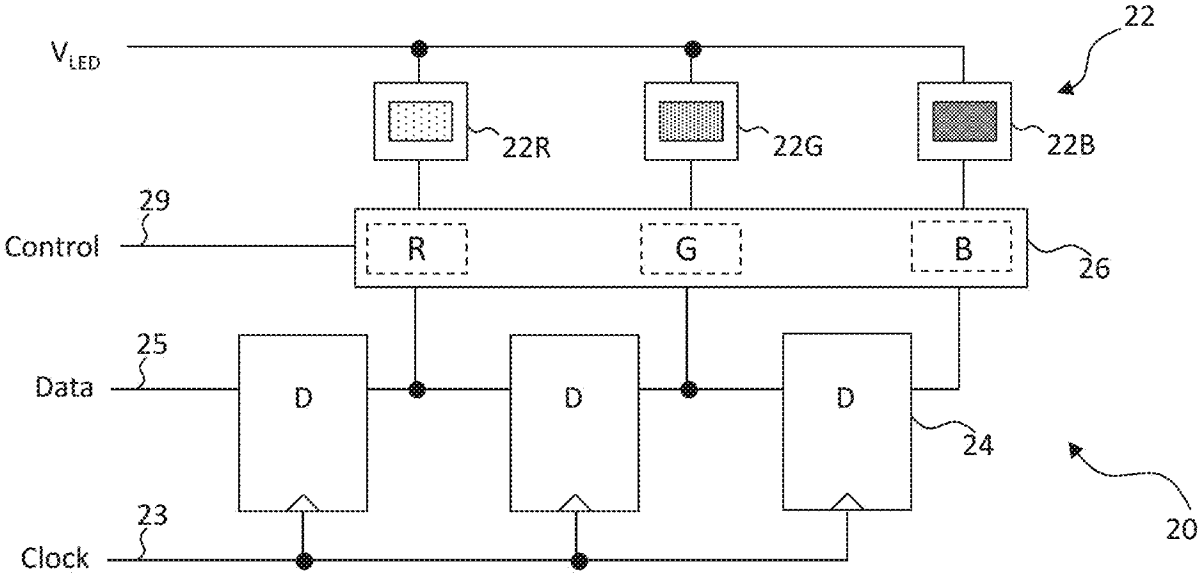
FIGS. 6 and 7 are schematic diagrams of alternative pixel circuits according to embodiments of the present invention.
Figure 7:
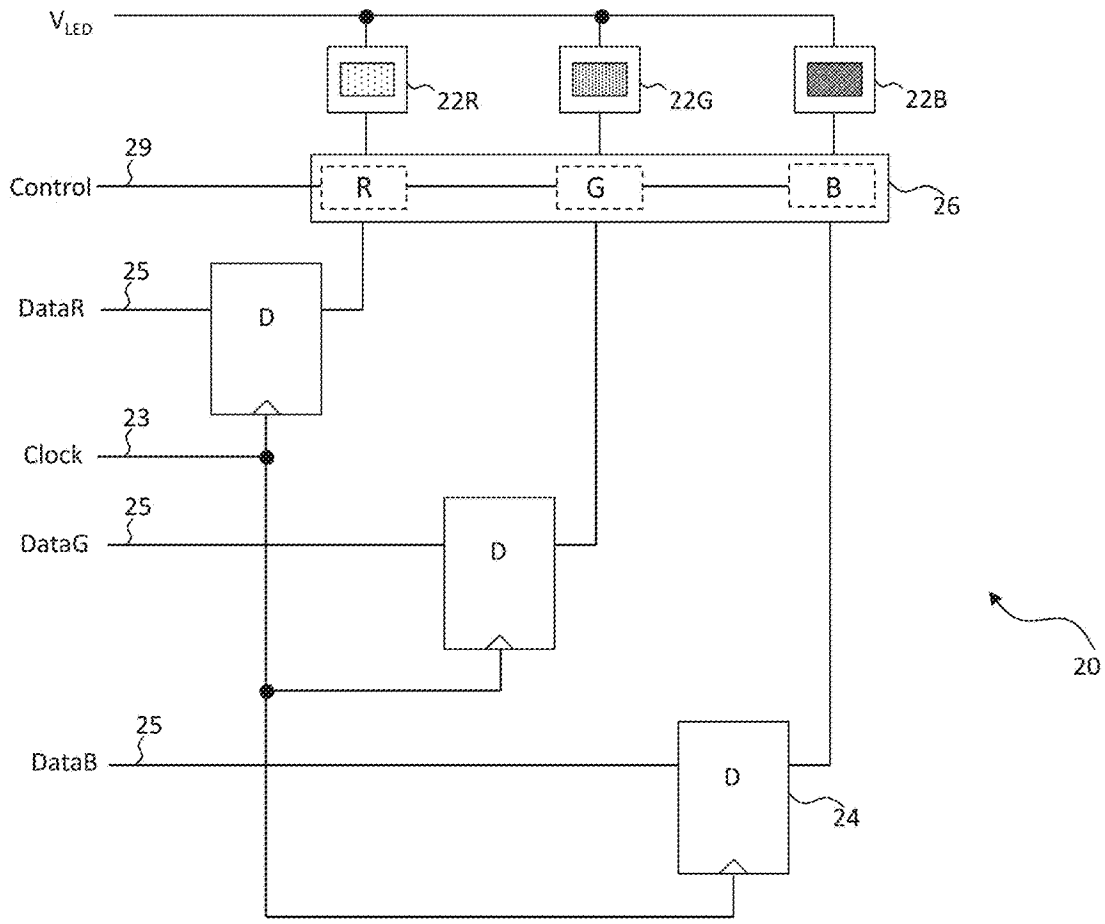

Referring to the embodiments of FIGS. 6 and 7, each display pixel 20 includes a digit memory 24 for each of the red, green, and blue digital pixel values, a drive circuit 26 that includes a bit-to-current converter that drives each of the red, green, and blue light emitters 22R, 22G, 22B with a constant pre-determined current for a time period in response to the corresponding red, green, and blue digital pixel values stored in the digit memories 24 and in response to the control signal 29. The red, green, and blue light emitters 22R, 22G, 22B can be micro LEDs, the digit memories can be D flip-flops, and the pixel controller 40 can include logic circuits (for example AND circuits) that combine the digital control signal 29 with the digital pixel value in each digit memory 24 and includes drive transistors forming a constant current circuit that drives the light emitters 22 when the control signal 29 is enabled and the digital pixel value (e.g., bit value) is non-zero. Digital memory 24 circuits and drive circuits 26 can be formed in semiconductors (e.g. CMOS in silicon).

As shown in FIG. 6, the digit memories 24 are sequentially connected in a serial three-bit D flip-flop shift register operated by a clock signal 23. In this embodiment, the red, green, and blue digit values 25 can be sequentially shifted into the flip-flops. In the alternative embodiment shown in FIG. 7, the three D flip-flops are arranged in parallel and the three red, green, and blue digit values 25 are loaded in parallel at the same time, for example with a common clock signal 23, into the three D flip-flops. This alternative arrangement reduces the time necessary to load the digit values 25 into the digit memory 24 (requiring one clock cycle instead of three clock cycles) at the expense of more input connections (requiring three connections instead of one connection). In either case, the control signal 29 can be enabled after the three digits are loaded into the digit memories 24. Correspondingly, the loading circuit 32 of the display controller 30 includes circuitry that loads a digit of each digital pixel value for each of the different colors either sequentially (as shown in FIG. 6) or in parallel (as shown in FIG. 7) before enabling the control signal 29. The control signal 29 is enabled for a period of time corresponding to the digit place of the loaded digits.

Referring further to FIGS. 8 and 9A-9D, the binary digital pixel values of an example four-by-four single-color image are illustrated. In FIG. 8, the binary values are shown, for example the upper left digital pixel value in the digital image is 1011 and the bottom right digital pixel value is 1110. FIGS. 9A-9D illustrate the bit-planes corresponding to the digital pixel values of the four-by-four single color image. FIG. 9A represents the first bit place corresponding to the least significant bit (LSB) bit plane in the ones place. FIG. 9B represents the bit plane corresponding to the second bit place in the twos place. FIG. 9C represents the bit plane corresponding to the third bit place in the fours place. FIG. 9D represents the bit plane corresponding to the fourth bit place (the most significant bit or MSB) in the eights place.

Figure 12:
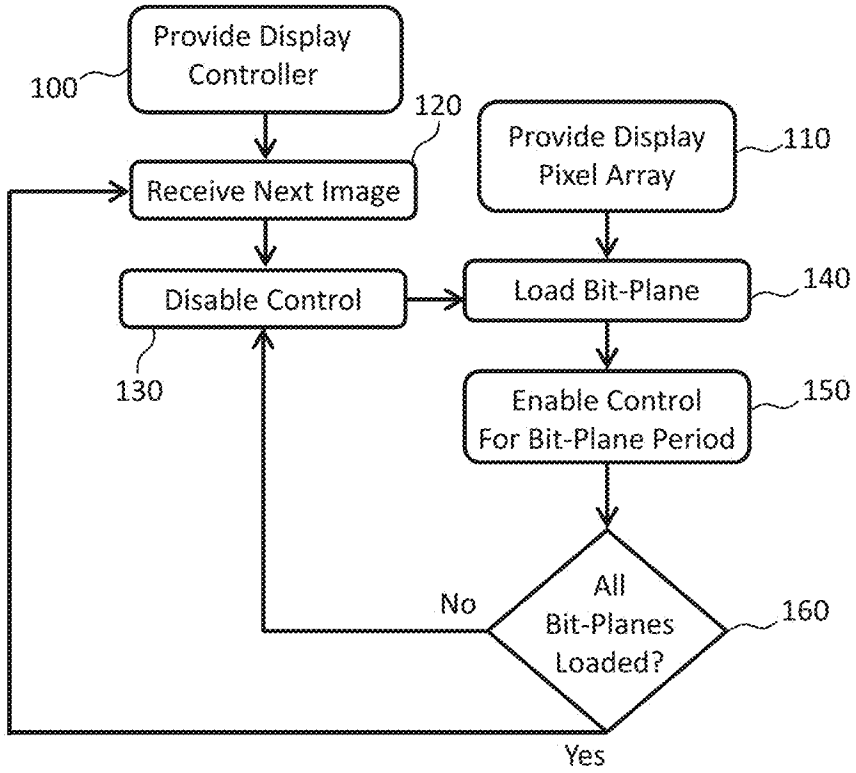
FIG. 12 is a flow chart illustrating a method of the present invention.

In a method of the present invention and referring also to FIG. 12, an array of display pixels 20 and a display controller 30 as described above are provided in steps 100 and 110. An image having a multi-digit digital pixel value for each image pixel in the image and each image pixel corresponding to a display pixel 20 is received by the display controller 30 in step 120 and the control signal 29 disabled in step 130. A bit plane (for example any of the bit planes 9A-9D in the four-digit pixel value image) is loaded into the display pixels 20 in step 140 and the control signal 29 enabled in step 150 for a period of time corresponding to the bit place of the bit plane. If all of the bit planes have been loaded (step 160) a new image is received in step 120. If not all of the bit planes have been loaded, the control signal 29 is disabled in step 130, a different bit plane is loaded in step 140, and the control signal 29 is enabled in step 150 for a period of time corresponding to the bit place of the bit plane. Thus, the display controller 30 repeatedly loads a different bit-plane digit of each image digital pixel value into a corresponding display pixel 20 and enables the control signal 29 for a period of time corresponding to the digit place of the loaded digit until all of the digits in the image pixel value have been loaded and enabled.

If the image is a color image, the loading circuit 32 of the display controller 30 includes circuitry for serially shifting a digit of each multi-digit digital pixel value for each of the different colors into the digit memories 24 of each display pixel 20. The digit memory 24 can include a red, a green, and a blue one-bit memory, each one-bit memory storing a digit of a corresponding red, green, or blue multi-digit digital pixel value.

Figure 10:
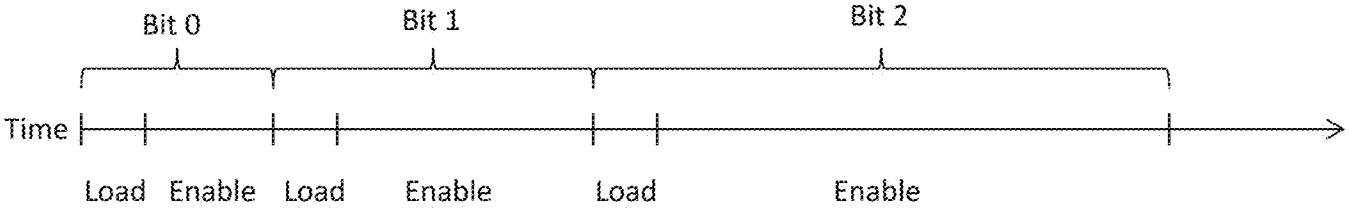
FIGS. 10 and 11 illustrate bit-plane pulse width modulation timing.

The bits of the multi-digit digital pixel value can be loaded in any order, so long as the time period for which the control signal 29 is enabled corresponds to the bit place of the loaded bit-plane. In various embodiments, the loading circuit 32 includes circuitry for loading the different digits of the multi-digit digital pixel value in ascending or descending digit-place order. For example, referring to FIG. 10, the bit planes are loaded in ascending order by digit-place value (bit 0 first, bit 1 second, bit 2 third and so on so that the LSB is loaded first and the MSB last). In an alternative, the bit-planes are loaded in a scrambled digit-place order that is neither ascending nor descending and the loading circuit 32 includes circuitry for loading the different digits of the multi-digit digital pixel value in a scrambled digit-place order that is neither ascending nor descending. This can help to reduce flicker.

Figure 11:
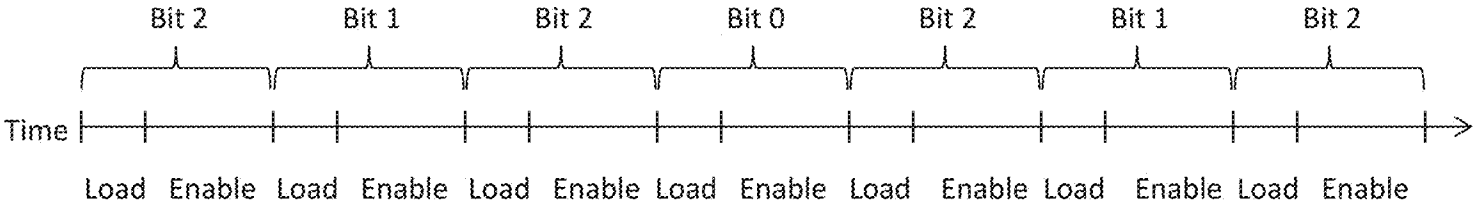

Referring to FIG. 11, the time periods for which the control signal 29 is enabled for each bit-plane can be subdivided to further reduce flicker. As shown in FIG. 11, the time period associated with each bit plane is divided into portions corresponding to the time period of the LSB (thus the LSB time period is not subdivided in this example, although in another embodiment the LSB time period is subdivided). The various portions of the time periods corresponding to each bit plane are then temporally intermixed. As shown in the example of FIG. 11, the bit plane for bit two is first loaded and then enabled for one time period portion, the bit plane for bit one is then loaded and enabled for one time period portion, the bit plane for bit two is then loaded again and enabled for one time period portion, the bit plane for bit zero is loaded and then enabled for one time period portion, the bit plane for bit two is loaded and then enabled for one time period portion, the bit plane for bit one is then loaded and enabled for one time period portion, and finally the bit plane for bit two is loaded and enabled for one time period portion. Each bit plane is enabled for the corresponding number of time periods (bit plane two is enabled for four time periods, bit plane one is enabled for two time periods, and bit plane one is enabled for one time period). Although repeated load cycles are necessary for this method, if the load time is a small fraction of the enable time period flicker is reduced.

Thus, in this design, the loading circuit 32 of the display controller 30 includes circuitry for repeatedly loading a digit of each multi-digit digital pixel value into a corresponding display pixel 20 and the control circuit 34 enables the control signal 29 for each of the repeated loadings for the corresponding bit-place time period divided by the number of times the digit is repeatedly loaded. The loading circuit 32 includes circuitry for loading a different digit of the multi-digit digital pixel value into a corresponding display pixel 20 between the repeated loadings of the digit.

In an embodiment of the present invention, the image is a two-dimensional image and the display controller 30 loads all of the image pixel values into the array of display pixels 20 before enabling the control signal 29. Thus, in this embodiment an entire image frame is loaded before any light emitters 22 are enabled. In another embodiment of the present invention, the display controller 30 loads a row (or multiple rows less than the number of rows in the image) into the array of display pixels 20 before enabling the control signal 29. In this alternative embodiment, rows of a two-dimensional image are successively loaded and enabled, so that rows of different image frames are displayed, which can provide smoother perceived motion by an observer. In a further embodiment of the present invention, the display pixels 20 are arranged in rows and at least one row of display pixels 20 is loaded or enabled out of phase with another row of display pixels 20.

Figure 13:
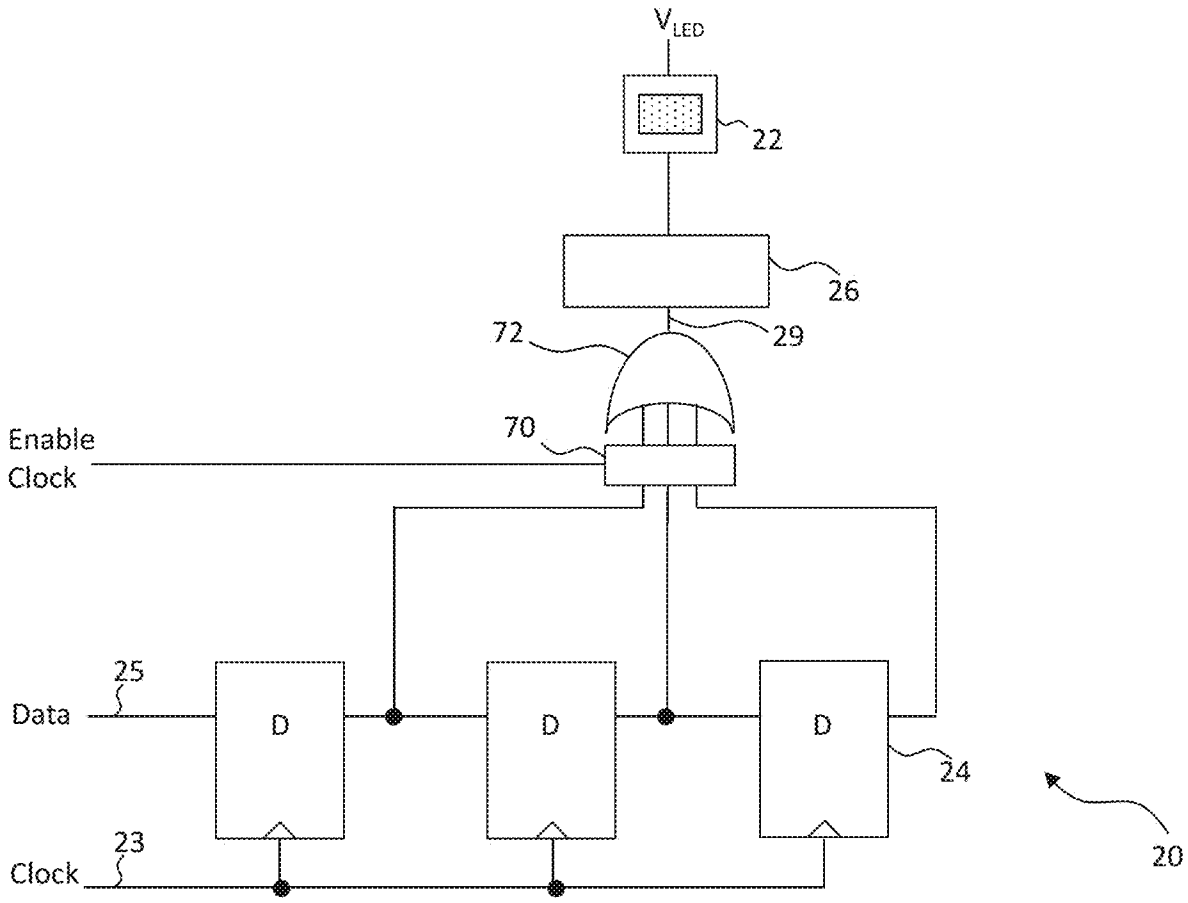
FIG. 13 is a schematic diagram of an embodiment of the present invention.

Referring to FIG. 13, in another embodiment, the time period for emitting light is formed with a counter 70 controlled by an enable clock signal. Each digital pixel value is stored in a counter 70 and as long as the counter 70 stores a non-zero value, the corresponding light emitter 22 is controlled to emit light. When the counter 70 has a zero value, the corresponding light emitter 22 does not emit light. An OR logic circuit 72 can input the output digit values of the counter 70. When any of the counter output digit values is non-zero, the drive circuit 26 is enabled. When all of the counter output digit values are zero, the drive circuit 26 is disabled. The different display pixels 20 in the array of display pixels 20 can have enable clock signals that are out of phase to reduce the visibility of flicker. Therefore, in an embodiment of the present invention, a pixel circuit for a digital display system 10 includes a light emitter 22, a digital digit memory 24 for storing at least one digit of a digital pixel value, a control signal 29, and a drive circuit 26 that drives the light emitter 22 when the digit memory 24 stores a non-zero digit value. In the embodiment of FIG. 13, the digital memory 24 can store multiple digits of the digital pixel value. The counter 70 can be or include the digital memory 24. The pixel circuit can include a counter 70 responsive to the stored digital pixel value and providing a control signal 29 enabling light output for a period of time corresponding to the digital pixel value.

The pixel controller 40 and the light emitters 22 can be made in one or more integrated circuits having separate, independent, and distinct substrates from the display substrate 50. The pixel controller 40 and the light emitters 22 can be chiplets: small, unpackaged integrated circuits such as unpackaged dies interconnected with wires 60 connected to contact pads on the chiplets. The chiplets can be disposed on an independent substrate, such as the display substrate 50. In an embodiment, the chiplets are made in or on a semiconductor wafer and have a semiconductor substrate. The display substrate 50 or the pixel substrate 42 includes glass, resin, polymer, plastic, or metal. Alternatively, the pixel substrate 42 is a semiconductor substrate and the digital memory 24 or the drive circuit 26 are formed in or on and are native to the pixel substrate 42. The light emitters 22 and the pixel controller 40 for one display pixel 20 or multiple display pixels 20 can be disposed on the pixel substrate 42 and the pixel substrate 42 are typically much smaller than the display substrate 50. Semiconductor materials (for example silicon or GaN) and processes for making small integrated circuits are well known in the integrated circuit arts. Likewise, backplane substrates and means for interconnecting integrated circuit elements on the backplane are well known in the printed circuit board arts. The chiplets (e.g., pixel controller 40, pixel substrate 42, or light-emitter substrates 28) can be applied to the display substrate 50 using micro transfer printing.

The chiplets or pixel substrates 42 can have an area of 50 square microns, 100 square microns, 500 square microns, or 1 square mm and can be only a few microns thick, for example 5 microns, 10 microns, 20 microns, or 50 microns thick.

In one method of the present invention, the pixel controller 40 or the light emitters 22 are disposed on the display substrate 50 by micro transfer printing. In another method, the pixel controller 40 and light emitters 22 are disposed on the pixel substrate 42 and the pixel substrates 42 are disposed on the display substrate 50 using compound micro assembly structures and methods, for example as described in U.S. patent application Ser. No. 14/822,868 filed Aug. 10, 2015, entitled Compound Micro-Assembly Strategies and Devices, the content of which is hereby incorporated by reference in its entirety. However, since the pixel substrates 42 are larger than the pixel controller 40 or light emitters 22, in another method of the present invention, the pixel substrates 42 are disposed on the display substrate 50 using pick-and-place methods found in the printed-circuit board industry, for example using vacuum grippers. The pixel substrates 42 can be interconnected with the display substrate 50 using photolithographic methods and materials or printed circuit board methods and materials. For clarity, the pixel substrate 42, pixel controller 40, and light emitter 22 electrical interconnections are omitted from FIG. 1.

In useful embodiments the display substrate 50 includes material, for example glass or plastic, different from a material in an integrated-circuit substrate, for example a semiconductor material such as silicon or GaN. The light emitters 22 can be formed separately on separate semiconductor substrates, assembled onto the pixel substrates 42 and then the assembled unit is located on the surface of the display substrate 50. This arrangement has the advantage that the display pixels 20 can be separately tested on the pixel substrate 42 and the pixel substrate 42 accepted, repaired, or discarded before the pixel substrate 42 is located on the display substrate 50, thus improving yields and reducing costs.

In an embodiment, the drive circuits 26 drive the light emitters 22 with a current-controlled drive signal. The drive circuits 26 can convert a digital display pixel value to a to a current drive signal, thus forming a bit-to-current converter. Current-drive circuits, such as current replicators, can be controlled with a pulse-width modulation scheme whose pulse width is determined by the digital bit value. A separate drive circuit 26 can be provided for each light emitter 22, or a common drive circuit 26 (as shown), or a drive circuit 26 with some common components can be used to drive the light emitters 22 in response to the digital pixel values stored in the digital memory 24. Power connections, ground connections, and clock signal connections can also be included in the pixel controller 40.

In embodiments of the present invention, providing the display controller 30, the light emitters 22, and the pixel controller 40 can include forming conductive wires 60 on the display substrate 50 or pixel substrate 42 by using photolithographic and display substrate 50 processing techniques, for example photolithographic processes employing metal or metal oxide deposition using evaporation or sputtering, curable resin coatings (e.g. SU8), positive or negative photo-resist coating, radiation (e.g. ultraviolet radiation) exposure through a patterned mask, and etching methods to form patterned metal structures, vias, insulating layers, and electrical interconnections. Inkjet and screen-printing deposition processes and materials can be used to form patterned conductors or other electrical elements. The electrical interconnections, or wires 60, can be fine interconnections, for example having a width of less than 50 microns, less than 20 microns, less than 10 microns, less than five microns, less than two microns, or less than one micron. Such fine interconnections are useful for interconnecting chiplets, for example as bare dies with contact pads and used with the pixel substrates 42. Alternatively, wires 60 can include one or more crude lithography interconnections having a width from 2 μm to 2 mm, wherein each crude lithography interconnection electrically connects the pixel substrates 42 to the display substrate 50.

In an embodiment, the light emitters 22 (e.g. micro-LEDs) are micro transfer printed to the pixel substrates 42 or the display substrate 50 in one or more transfers. For a discussion of micro-transfer printing techniques see, U.S. Pat. Nos. 8,722,458, 7,622,367 and 8,506,867, each of which is hereby incorporated in its entirety by reference. The transferred light emitters 22 are then interconnected, for example with conductive wires 60 and optionally including connection pads and other electrical connection structures, to enable the display controller 30 to electrically interact with the light emitters 22 to emit light in the digital-drive display system 10 of the present invention. In an alternative process, the transfer of the light emitters 22 is performed before or after all of the conductive wires 60 are in place. Thus, in embodiments the construction of the conductive wires 60 can be performed before the light emitters 22 are printed or after the light emitters 22 are printed or both. In an embodiment, the display controller 30 is externally located (for example on a separate printed circuit board substrate) and electrically connected to the conductive wires 60 using connectors, ribbon cables, or the like. Alternatively, the display controller 30 is affixed to the display substrate 50 outside the display area, for example using surface mount and soldering technology, and electrically connected to the conductive wires 60 using wires 60 and buses formed on the display substrate 50.

In an embodiment of the present invention, an array of display pixels 20 (e.g., as in FIG. 1) can include 40,000, 62,500, 100,000, 500,000, one million, two million, three million, six million or more display pixels 20, for example for a quarter VGA, VGA, HD, or 4*k* display having various resolutions. In an embodiment of the present invention, the light emitters 22 can be considered integrated circuits, since they are formed in a substrate, for example a wafer substrate, using integrated-circuit processes.

The display substrate 50 usefully has two opposing smooth sides suitable for material deposition, photolithographic processing, or micro-transfer printing of micro-LEDs. The display substrate 50 can have a size of a conventional display, for example a rectangle with a diagonal of a few centimeters to one or more meters. The display substrate 50 can include polymer, plastic, resin, polyimide, PEN, PET, metal, metal foil, glass, a semiconductor, or sapphire and have a transparency greater than or equal to 50%, 80%, 90%, or 95% for visible light. In some embodiments of the present invention, the light emitters 22 emit light through the display substrate 50. In other embodiments, the light emitters 22 emit light in a direction opposite the display substrate 50. The display substrate 50 can have a thickness from 5 to 10 microns, 10 to 50 microns, 50 to 100 microns, 100 to 200 microns, 200 to 500 microns, 500 microns to 0.5 mm, 0.5 to 1 mm, 1 mm to 5 mm, 5 mm to 10 mm, or 10 mm to 20 mm. According to embodiments of the present invention, the display substrate 50 can include layers formed on an underlying structure or substrate, for example a rigid or flexible glass or plastic substrate.

In an embodiment, the display substrate 50 can have a single, connected, contiguous display substrate area 52 that includes the light emitters 22 and the light emitters 22 each have a light-emissive area 44 (FIG. 2). The combined light-emissive areas 44 of the plurality of light emitters 22 is less than or equal to one-quarter of the contiguous display substrate area 52. In further embodiments, the combined light-emissive areas 44 of the plurality of light emitters 22 is less than or equal to one eighth, one tenth, one twentieth, one fiftieth, one hundredth, one five-hundredth, one thousandth, one two-thousandth, or one ten-thousandth of the contiguous display substrate area 52. The light-emissive area 44 of the light emitters 22 can be only a portion of the light emitter 22. In a typical light-emitting diode, for example, not all of the semiconductor material in the light-emitting diode necessarily emits light. Therefore, in another embodiment, the light emitters 22 occupy less than one quarter of the display substrate area 52.

In an embodiment of the present invention, the light emitters 22 are micro-light-emitting diodes (micro-LEDs), for example having light-emissive areas 44 of less than 10, 20, 50, or 100 square microns. In other embodiments, the light emitters 22 have physical dimensions that are less than 100 μm, for example having a width from 2 to 5 μm, 5 to 10 μm, 10 to 20 μm, or 20 to 50 μm, having a length from 2 to 5 μm, 5 to 10 μm, 10 to 20 μm, or 20 to 50 μm, or having a height from 2 to 5 μm, 4 to 10 μm, 10 to 20 μm, or 20 to 50 μm. The light emitters 22 can have a size of one square micron to 500 square microns. Such micro-LEDs have the advantage of a small light-emissive area 44 compared to their brightness as well as color purity providing highly saturated display colors and a substantially Lambertian emission providing a wide viewing angle.

According to various embodiments, the digital-drive display system 10, for example as used in a digital display of the present invention, includes a variety of designs having a variety of resolutions, light emitter 22 sizes, and displays having a range of display substrate areas 52. For example, display substrate areas 52 ranging from 1 cm by 1 cm to 10 m by 10 m in size are contemplated. In general, larger light emitters 22 are most useful, but are not limited to, larger display substrate areas 52. The resolution of light emitters 22 over a display substrate 50 can also vary, for example from 50 light emitters 22 per inch to hundreds of light emitters 22 per inch, or even thousands of light emitters 22 per inch. For example, a three-color display can have one thousand 10μ× 10μ light emitters 22 per inch (on a 25-micron pitch). Thus, the present invention has application in both low-resolution and very high-resolution displays. An approximately one-inch 128-by-128 pixel display having 3.5 micron by 10-micron emitters has been constructed and successfully operated as described in U.S. patent application Ser. No. 14/743,981 filed Jun. 18, 2015, entitled Micro-Assembled Micro LED Displays and Lighting Elements, the content of which is hereby incorporated by reference in its entirety.

As shown in FIG. 1, the display pixels 20 form a regular array on the display substrate 50. Alternatively, at least some of the display pixels 20 have an irregular arrangement on the display substrate 50.

In an embodiment, the chiplets are formed in substrates or on supports separate from the display substrate 50. For example, the light emitters 22 are separately formed in a semiconductor wafer. The light emitters 22 are then removed from the wafer and transferred, for example using micro transfer printing, to the display substrate 50 or pixel substrate 42. This arrangement has the advantage of using a crystalline semiconductor substrate that provides higher-performance integrated circuit components than can be made in the amorphous or polysilicon semiconductor available on a large substrate such as the display substrate 50.

By employing a multi-step transfer or assembly process, increased yields are achieved and thus reduced costs for the digital-drive display system 10 of the present invention. Additional details useful in understanding and performing aspects of the present invention are described in U.S. patent application Ser. No. 14/743,981 filed Jun. 18, 2015, entitled Micro-Assembled Micro LED Displays and Lighting Elements.

Figure 14:
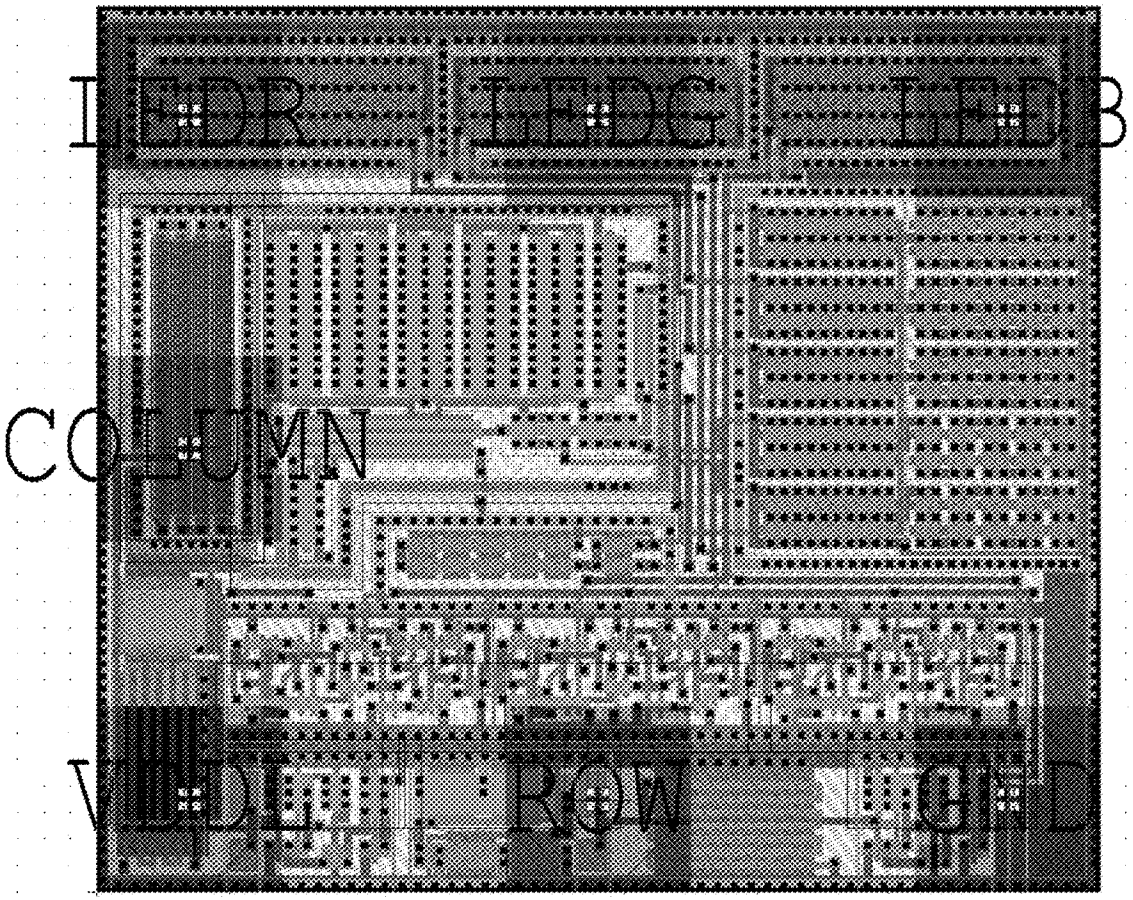
FIG. 14 is a layout diagram of a chiplet embodiment of the present invention.

The present invention has been designed for a 250-by-250 full-color active-matrix micro-LED display on a two-inch square glass or plastic display substrate 50. As shown in FIG. 14, a 38-micron by 33.5 micron chiplet includes the circuit illustrated in FIG. 6. The array of display pixels 20 are driven by a display controller 30 incorporating a field-programmable gate array (FPGA) and the digital-drive display 10 is driven by column drivers providing digital pixel values to each row of the array and row select signals to select the row corresponding to the digital pixel values. The chiplets are formed in a silicon wafer and micro transfer printed to the display substrate 50. The chiplets are arranged in redundant pairs over the substrate. In operation, successive digital pixel value bit-planes of a digital image are loaded into the digital display and the control signal 29 is enabled for time periods corresponding to the bit place of the corresponding bit-plane by the FPGA display controller 30.

As is understood by those skilled in the art, the terms "over", "under", "above", "below", "beneath", and "on" are relative terms and can be interchanged in reference to different orientations of the layers, elements, and substrates included in the present invention. For example, a first layer on a second layer, in some embodiments means a first layer directly on and in contact with a second layer. In other embodiments, a first layer on a second layer can include another layer there between.

Having described certain embodiments, it will now become apparent to one of skill in the art that other embodiments incorporating the concepts of the disclosure may be used. Therefore, the invention should not be limited to the described embodiments, but rather should be limited only by the spirit and scope of the following claims.

Throughout the description, where apparatus and systems are described as having, including, or comprising specific components, or where processes and methods are described as having, including, or comprising specific steps, it is contemplated that, additionally, there are apparatus, and systems of the disclosed technology that consist essentially of, or consist of, the recited components, and that there are processes and methods according to the disclosed technology that consist essentially of, or consist of, the recited processing steps.

It should be understood that the order of steps or order for performing certain action is immaterial so long as the disclosed technology remains operable. Moreover, two or more steps or actions in some circumstances can be conducted simultaneously. The invention has been described in detail with particular reference to certain embodiments thereof, but it will be understood that variations and modifications can be effected within the spirit and scope of the invention.

PARTS LIST

10 digital-drive display system
20 display pixel
22 light emitter
22R red light emitter
22G green light emitter
22B blue light emitter
23 clock signal
24 digital memory/digit memory
25 digit value
26 drive circuit
27 light-emitter substrate
28 control signal
30 display controller
32 loading circuit
34 control circuit
36 display controller substrate
40 pixel controller
42 pixel substrate
44 light-emissive area
50 display substrate
52 display substrate area
60 wires
70 counter
72 OR logic circuit
100 provide display controller step
110 provide display pixel array step
120 receive next image step
130 disable control step
140 load bit-plane step
150 enable control for bit-plane period step
160 all bit-planes loaded decision step

What is claimed:

1. A digital-drive display system, comprising:
a display substrate having a display substrate area;
an array of display pixels disposed on the display substrate in the display substrate area;
a display controller that provides a timing signal to every display pixel in the array of display pixels, wherein each display pixel comprises:
a light emitter; and
a pixel controller comprising a digital memory for storing a multi-digit digital pixel value, and a drive circuit that drives the light emitter to emit light in response to the digital pixel value and to the timing signal, wherein the drive circuit provides a constant current independent of the stored multi-digit digital pixel value that is supplied to the light emitter for a time period defined by the timing signal and corresponding to the value of the stored multi-digit digital pixel value, wherein the time period is the sum of each period for which the drive circuit drives the light emitter to emit light in response to the digital pixel value.

2. The digital-drive display system of claim 1, wherein the light emitter is a red light emitter that emits red light and comprising a blue light emitter that emits blue light and a green light emitter that emits green light, wherein the digital memory stores a red digital pixel value, a green digital pixel value, and a blue digital pixel value, and wherein the drive circuit drives the red, green, and blue light emitters to emit light in response to the corresponding red, green, and blue digital pixel values stored in the digital memory.

3. The digital-drive display system of claim 1, comprising a display controller for controlling the display pixels that comprises a loading circuit for loading at least one digit of the multi-digit digital pixel value in the digital memory of each display pixel and a control circuit for controlling a control signal connected to each display pixel in common.

4. The digital-drive display system of claim 3, comprising:
a color image having pixels comprising different colors and a multi-digit digital pixel value for each color of each pixel in the image, wherein each display pixel in the array of display pixels comprises a color light emitter for each of the different colors that emits light of the corresponding color, a digital memory for storing at least one digit of a digital pixel value for each of the different colors, and a drive circuit for each of the different colors that drives each color of light emitter to emit light when the corresponding digital memory stores a non-zero digit value and the control signal is enabled.

5. The digital-drive display system of claim 4, wherein the digit memories for each of the different colors in each display pixel are connected in a serial shift register and the loading circuit comprises circuitry for serially shifting a digit of each multi-digit digital pixel value for each of the different colors into the digit memories of each display pixel.

6. The digital-drive display system of claim 1, wherein the timing signal is a pulse-width modulation (PWM) signal.

7. The digital-drive display system of claim 1, wherein the digits of the multi-digit digital pixel value are ordered in ascending place value or descending place value.

8. The digital-drive display system of claim 1, wherein the digits of the multi-digit digital pixel value are ordered in a scrambled place value that is neither ascending nor descending.

9. The digital-drive display system of claim 1, wherein the time period associated with each digit of the multi-digit digital pixel is subdivided into portions and the portions and different digits are temporally intermixed by the display and pixel controller.

10. The digital-drive display system of claim 1, wherein the display controller provides a timing signal to every display pixel in a row of display pixels at a same time.

11. The digital-drive display system of claim 10, wherein different rows of pixels in the array of display pixels receive timing signals that are out of phase.

12. The digital-drive display system of claim 1, wherein different rows of display pixels in the array of display pixels have clock signals that are out of phase.

13. A method for controlling a digital display system, comprising:
providing an array of display pixels disposed on a display substrate area of the display substrate, wherein each display pixel comprises:
a light emitter, and
a pixel controller comprising a digital memory for storing a multi-digit digital pixel value, and a drive circuit that drives the light emitter to emit light in response to the digital pixel value and to a timing signal, wherein the drive circuit provides a constant current independent of the stored multi-digit digital pixel value that is supplied to the light emitter for a time period defined by the timing signal and corresponding to the value of the stored multi-digit digital pixel value, wherein the time period is the sum of the periods for which the drive circuit drives the light emitter to emit light in response to the digital pixel value;

providing a display controller for receiving an image having a digital pixel value for each image pixel in the image, each image pixel corresponding to a display pixel; and loading, via the display controller, the digital pixel values into the digital memory of the corresponding display pixel so that the drive circuit drives the light emitter to emit light in response to the digital pixel value stored in the digital memory.

14. A method for controlling a digital display system, comprising:

providing an array of display pixels disposed on a display substrate area of the display substrate and a display controller for controlling the display pixels, wherein each display pixel comprises:

a light emitter, and a pixel controller comprising a digital memory for storing a multi-digit digital pixel value, and a drive circuit that drives the light emitter to emit light in response to the digital pixel value and to a timing signal, wherein the drive circuit provides a constant current independent of the stored multi-digit digital pixel value that is supplied to the light emitter for a time period defined by the timing signal and corresponding to the value of the stored multi-digit digital pixel value, wherein the time period is the sum of the periods for which the drive circuit drives the light emitter to emit light in response to the digital pixel value, wherein the display controller comprises:

a loading circuit for loading at least one digit of the multi-digit digital pixel value in the digital memory of each display pixel and a control circuit for controlling a control signal connected to each display pixel in common;

receiving, via the display controller, an image having a multi-digit digital pixel value for each image pixel in the image, each image pixel corresponding to a display pixel; and repeatedly loading, via the display controller, a different digit of each image pixel value into a corresponding display pixel until all of the digits in the image pixel value have been loaded and enabled.

15. The method of claim 14, wherein:

the image is a color image having pixels comprising different colors and a multi-digit digital pixel value for each color of each pixel in the image; and each display pixel in the array of display pixels comprises a color light emitter for each of the different colors that emits light of the corresponding color, a digital memory for storing at least one digit of a multi-digit digital pixel value for each of the different colors, and a drive circuit for each of the different colors that drives each color of light emitter when the corresponding digital memory stores a non-zero digit value and the control signal is enabled.

16. The method of claim 15, wherein the digit memories for each of the different colors in each display pixel are connected in a serial shift register and a digit for each digital image pixel value for each of the different colors is serially shifted into the digit memories of each display pixel.

17. The method of claim 14, wherein the image is a two-dimensional image and the display controller (i) loads all of the image pixel values into the array of display pixels before enabling the control signal, (ii) the display pixels are arranged in rows and the display controller loads a row of display pixels before enabling the control signal, or (iii) the display pixels are arranged in rows and at least one row of display pixels is loaded or enabled out of phase with another row of display pixels.

18. The method of claim 14, wherein the digits are loaded in ascending digit-place order or descending digit-place order.

19. The method of claim 14, wherein the digits are loaded in a scrambled digital-place order that is neither ascending nor descending.

20. A digital-drive display system, comprising:

a display substrate having a display substrate area;

an array of display pixels disposed on the display substrate in the display substrate area;

a display controller that provides a timing signal to every pixel in the array of display pixels, wherein each display pixel comprises:

a light emitter, and a pixel controller comprising a digital memory for storing a multi-digit digital pixel value and a drive circuit that drives the light emitter to emit light in response to the digital pixel value and to a timing signal wherein the drive circuit provides a constant current independent of the stored multi-digit digital pixel value that is supplied to the light emitter for a time period defined by the timing signal and corresponding to the value of the stored multi-digit digital pixel value, wherein the time period is a bit period or a bit period times the place of a bit in the multi-digit digital pixel value, and wherein the multi-digit digital pixel value is a binary value.

21. The digital-drive display system of claim 20, wherein the display controller provides a timing signal to every display pixel in a row of display pixels at a same time.

22. The digital-drive display system of claim 21, wherein different rows of pixels in the array of display pixels receive timing signals that are out of phase.

* * * * *